US009884235B2

(12) United States Patent
Min

(10) Patent No.: US 9,884,235 B2
(45) Date of Patent: Feb. 6, 2018

(54) SYSTEM AND METHOD FOR A MULTI-STATIONS SPORT GAME

(71) Applicant: Aung Min, Yangon (MM)

(72) Inventor: Aung Min, Yangon (MM)

( * ) Notice: Subject to any disclaimer, the term of this patent is extended or adjusted under 35 U.S.C. 154(b) by 7 days.

(21) Appl. No.: 14/999,251

(22) Filed: Apr. 15, 2016

(65) Prior Publication Data

US 2017/0296894 A1 Oct. 19, 2017

(51) Int. Cl.

| | |
|---|---|
| ***A63F 13/12*** | (2006.01) |
| ***A63B 67/00*** | (2006.01) |
| ***A63G 31/02*** | (2006.01) |

(52) U.S. Cl.

CPC ..... *A63B 67/00* (2013.01); *A63G 31/02* (2013.01)

(58) Field of Classification Search

None

See application file for complete search history.

(56) References Cited

U.S. PATENT DOCUMENTS

| | | | | |
|---|---|---|---|---|
| 2004/0033833 | A1* | 2/2004 | Briggs | A63G 31/00 463/42 |
| 2006/0189386 | A1* | 8/2006 | Rosenberg | A63F 13/12 463/37 |
| 2009/0291782 | A1* | 11/2009 | Hinn | A63B 63/00 473/470 |
| 2013/0017911 | A1* | 1/2013 | Kessler | A63B 71/0669 473/470 |
| 2017/0007881 | A1* | 1/2017 | Penttila | H04W 4/008 |

OTHER PUBLICATIONS

Sinha, A., 'Chip Timing—What It Does and How it Works', Marathon Guide Website [retrieved from internet Apr. 14, 2015].< URL: https://web.archive.org/web/20040413023638/http://marathonguide.com/features/Articles/RaceTimingWithChip.cfm> published on Apr. 13, 2004 as per Wayback Machine.

Sinha A. "Chip Timing—What It Does and How it Works"; retrieved from http://www.marathonguide.com/features/Articles/RaceTimingWithChip.cfm; as early as Apr. 2004.

International-Type Search Report for National Application No. 2015900372 dated Apr. 21, 2015.

* cited by examiner

*Primary Examiner* — Jason Yen

(74) *Attorney, Agent, or Firm* — Brown & Michaels, PC

(57) ABSTRACT

A sport game which utilizes a plurality of play articles, at least three stations cum goals or targets, a playground, a game controller device and a display device is disclosed. The game is played by individual participant or participants wherein the rules of the game maintain a familiarity with an ancient puzzle game and is based on a mathematical formula of logarithmic scale where the play articles are moved around the stations by play participants to accrue points or goals and where the devices are incorporated with identification, tracking, data transmission, data processing, determination and data display capabilities to monitor and manage the game. The game provides physical, skill and cerebral challenges and is applicable to a plurality of normal sports wherein goal or target shooting is primal; the game can be played indoors or outdoors, for fun, exercise, training of sport skills, light or serious competition.

16 Claims, 8 Drawing Sheets

SYSTEM AND METHOD FOR A MULTI-STATIONS SPORT GAME

FIELD OF THE INVENTION

The present invention relates to games and sports and in particular to a method and system for providing a new multi-stations sport game.

The invention has been developed primarily for use in respect to rules of a new game and will be described hereinafter with reference to this application. However, it will be appreciated that the invention is not limited to this particular field of use.

BACKGROUND OF THE INVENTION

There are many games and sports in existence and a difficulty with having new games adopted is the fact that new rules can be unfamiliar and alien to what is already known.

The premise of the present invention is a new game whose rules maintain a familiarity with an old puzzle game. However, to implement the game in a modern context requires gaming equipment and systems which do not lend themselves to current popular games.

The present invention seeks to provide a gaming system, which will overcome or substantially ameliorate at least some of the deficiencies of the prior art, or to at least provide an alternative in order to facilitate the proposed new game.

It is to be understood that, if any prior art information is referred to herein, such reference does not constitute an admission that the information forms part of the common general knowledge in the art, in Australia or any other country.

SUMMARY OF THE INVENTION

According to a first aspect of the present invention there is provided a method for providing a game, wherein the rules of the game require a plurality of articles to be individually moved between different physical locations in a particular sequence at least by one game participant, the method providing:

at least three stations, each station being physically located apart from one another;

a plurality of movable articles, each article having a unique and detectable identity, wherein at the commencement of the game, all of the articles are located at a first of said stations in a specific sequence;

each station includes a detector for automatically detecting the identity of an article which is moved to the station;

a controller capable of receiving signals from each station, said signals identifying the station and identifying the article detected at the station; said controller processing the received signals to determine whether the correct article has been moved to the correct location in accordance with the rules of the game;

a display unit for displaying information at least to participants and game officials, and a playground capable to stage the game.

Preferably, upon determining whether the correct article has been moved to the correct location, the controller is arranged to send a signal of the determination to a respective station, whereby the determination is indicated by an indication device at the station. The indication device may be a visual indication device or an audio indication device.

Preferably, the system further includes a visual display, wherein said controller communicates with said display in order to display a progress of the game.

Preferably, the game is a competitive game between at least two players, the system further includes unique detectable identification devices to be provided to each player, wherein the identity of a player that moves an article to a station is communicated to the controller.

A system for providing the game is also provided.

Other aspects of the invention are also disclosed.

Embodiments of the present invention provide a set of specifically designed rings or disks or balls or rods of regular or irregular shapes and three specifically designed target stations or goals and a specifically designed central control unit device for a unique physical game that can be played either by one person, by three persons, by a group of persons, or by competing teams of players, either indoors or outdoors, on a standard playground designed for the particular game or sport or on specifically designed playgrounds relating to the invention, for fun and health, exercise and fitness, or for light or serious competition. In particular a set of specifically designed rings or disks or balls or rods of regular or irregular shapes with self-identification devices, electronic or otherwise, hereinafter described as 'move articles', are provided and three specifically designed target stations or goals incorporated with identification, tracking and/or data transmission devices, electronic or otherwise, and built to play a specific physical game, including moving, throwing or passing and catching the specifically designed rings or disks or balls or rods of regular or irregular shapes. The game also includes scoring points or goals and stacking or placing these 'move articles' on the three specifically designed target stations or goals on a specifically designed playground (field, pitch). The game can be played by a solo player, or multiple players playing solo or three players or groups of three players, or by competing teams of players, and operating in conjunction with a specifically designed central control processor unit device for data transmission, data processing and monitoring that the moves of the 'move articles' follow a set of specific game rules as programmed in the central control processor unit device. In particular cases, monitoring the moves of the players is also anticipated, and a display unit device for displaying related information of the ongoing game is provided. Moreover these 'move articles' included with the specifically designed equipment of the invention are adaptable for play in current established sports and games such as basketball, net ball, hand ball (Olympic handball or Team handball), water polo, rugby, football (soccer), hockey, golf, archery, polo, athletics, etc., with some changes and modifications to the established rules and method. These games can be played on specifically designed playgrounds (fields, pitches) which are constructed for the purpose of the unique game and the use of the articles of the invention, but are also relevant to established sports.

There are various types of articles provided for outdoor or indoor physical games in the prior art where articles are thrown or passed and caught, such as balls, rings, disks, etc., that are mainly played by family members, friends, school children, outdoor party goers, for amateur games or for professional games, etc, where the game is for fun and exercise or for some light and friendly competition, or professional competitions, and the participants are of various ages or physical build. One such game being freely throwing or passing and catching objects such as rings or disks or balls, played indoors or outdoors, such as at an indoor sports complex or the beach respectively, etc. However, there are very few articles designed for such games to follow a set of special game rules and method of play that are interesting and exciting, and that require not one but a set of several 'move articles' to be used during the playing of a game, and that require both light physical effort and mental concentration to enhance the enjoyment and yet are simple and easy to use, and with these 'move articles' in conjunction with and incorporated with electronic or other means of devices for the identification, tracking, data transmission, processing and displaying to enable monitoring with ease that the game follows a set of interesting, tantalizing and further on challenging, game rules. Furthermore, game articles of the prior art are not as versatile and suitable for use as game equipment in the game of the invention, the application of which can be further extended and adapted to play at escalated competitive levels for established sport games such as basketball, net ball, hand ball (Olympic handball or Team handball), water polo, rugby, football (soccer), hockey, golf, archery, polo, athletics, etc., iconoclastically introducing a set of three targets or goal posts or goal lines on a specifically designed playground (field, pitch) of the invention, where the players of both competing sides would play not for one ball only, but will tackle a set of several numbers of balls or the 'move articles' of the invention in turn, and attack simultaneously, at any one time, one target or goal which changes after each goal or point score, among the three targets or goals, and where for some sport, everyone of the players needs to be a total athlete as an attacker or striker and a defender, a winger, a central player, etc., at the same time, and the game playing within some changes and additions in established rules and methods of each established game.

There has been a mathematical formula since ancient times, namely ($m=2^n-1$) which is based on the mathematical puzzle called the Tower of Hanoi (also known as the Tower of Brahma or Lucas' Tower), and which in one embodiment of the invention is applied in the game of the invention. This game, for moving a set of 'n' number of articles, arranged or stacked in ascending order of sizes from the top to the bottom or conversely, in descending order of sizes from the bottom to the top, requires the articles to be moved one at a time from the original position to another position using an auxiliary third position, and following the rule that the article being moved is smaller in size than the article under it before the move and the article under it after the move, if there are any article or articles under it before the move or after the move in each position, and where 'm' is the minimum number of moves possible for 'n' numbers of articles to move. However, no physical games or sports of the prior art describe moving articles in accordance with this formula and which would be specifically designed in various forms to be adaptable to play in a physical game, which also includes articles adapted for playing many of the modern established sport games. By applying this formula and further deriving, formulating and developing the method and the sequence of moves for the 'move articles', and by designing, in an innovative way that would suit this game, the 'move articles' that are electronically or otherwise identifiable so that the movements of the 'move articles' can be tracked, electronically or otherwise. This can be done in tandem with the movements of the players in the particular games or sports, and the tracking and processing of game equipment, for monitoring and managing the movements of the 'move article' in a simple, accurate and easy manner is achieved. It is also possible by introducing a playground (field, pitch) of the invention, that accommodates three targets-come-goals or goal posts, there is provided a unique physical game or sport that can be played as the present invention teaches with the specific articles of invention.

Although numerous types of articles for a physical game of throwing or passing and catching including scoring points or goals have been provided in the prior art and adapted to be used, and these may be suitable for the specific individual purposes to which they address, they would not be suitable for the purpose of the present invention as heretofore described.

Hence making use of this formula, enhancing its derivatives and making further development, a set of rings or disks or balls or rods of regular or irregular shapes and the three stations or goals with an innovative and improved design are introduced so that a physical game can be played or exercised on a specific indoor or outdoor playground (field, pitch) involving the throwing and catching, passing or moving of the rings or disks or balls or rods of regular or irregular shapes, scoring points or goals, and stacking at the three target stations or goals by three persons or by one person or by a group of persons or by competing teams, and incorporated with a specifically designed control processor unit device and display devices for identifying, tracking, transmission, processing, managing and displaying, for simple and easy means to monitor that the moves follow a set of particularly developed game rules and methods.

A preferred embodiment provides a set of specifically designed rings or disks or balls or rods of regular or irregular shapes, three specifically designed stations or goals, a specifically designed central processor control unit device, a display unit and a specifically designed playground, that avoids the disadvantages and inadequacies of the prior art of rings, disks, balls or rods, for playing a unique physical game of throwing, passing and catching or moving.

Another preferred embodiment provides a set of specifically designed rings or disks or balls or rods of regular or irregular shapes, three specifically designed stations, a specifically designed central processor control unit device, a display unit, and a specific playground, that are simple and easy to use for the unique physical game.

Another preferred embodiment provides a set of specifically designed rings or disks or balls or rods of regular or irregular shapes, three specifically designed stations, a specifically designed central processor control unit device, a display unit, and a specifically designed playground, that are simple and inexpensive to manufacture.

Another preferred embodiment provides a set of specifically designed rings or disks or balls or rods of regular or irregular shapes that are in ascending order of sizes in diameter or of shape and of serial numbers from the top to the bottom or from the right to the left, or of the same shape and same size with ascending order of serial numbers within the set in play.

Another preferred embodiment provides a set of specifically designed rings or disks or balls or rods of regular or irregular shapes which can have from three specifically designed rings or disks or balls or rods of regular or irregular shapes up to any higher number 'x' of specifically designed rings or disks or balls or rods of regular or irregular shapes per set in play. For a typical game the number of the specifically designed rings or disks or balls or rods of regular or irregular shapes in a set in play can be from six units to twelve units but not limited to this.

Another preferred embodiment provides a set of specifically designed rings or disks or balls or rods of regular or irregular shapes that are stack-able or place able in its full set or in any number partially from the full set on a specifically designed station. The specifically designed rings or disks or balls type may have center holes of equal diameters, or of varying diameters or cone shape center holes of varying sizes related to their serial numbers, to slide onto a center rod on the specifically designed station.

Another preferred embodiment provides a set of specifically designed rings or disks or balls or rods of regular or irregular shapes that are of the weights, the sizes and the shapes of throw-able and catch-able or passable or movable by one hand or by two hands or by the feet, by the different age group or by the different physical built of the players. Typical weights may range from 100 gm to 300 gm for each specifically designed ring or disk or ball or rod, but not limited to this.

Another preferred embodiment provides a set of specifically designed rings or disks or balls or rods of regular or irregular shapes that are of the weights, the sizes and the shapes at throw-able and catch-able, passable or movable distance by the different age group or by the different physical built of the players. Typical distances may range from five meters to fifteen meters, but not limited to this.

Another preferred embodiment provides a set of specifically designed rings or disks or balls or rods of regular or irregular shapes and three specifically designed stations that are made of wood, rubber, leather, plastic, synthetic material, composite material, light metal, etc., but not limited to this, and suitable for throwing and catching, passing or moving the specifically designed rings or disk or balls or rods of regular or irregular shapes, and suitable for the purposes of the specifically designed stations.

Another preferred embodiment provides a set of specifically designed rings or disks or balls or rods of regular or irregular shapes that are distinctly marked with serial numbers of the ascending order to enhance visual identification of the sizes in the diameter or the shape or of the serial numbers in relation to their positions in the set in play.

Another preferred embodiment provides a set of specifically designed rings or disks or balls or rods of regular or irregular shapes that are in various different colors to enhance visual identification of the sizes in the diameter or the shape, or of the serial numbers in relation to their positions in the set in play.

Another preferred embodiment provides a set of specifically designed rings or disks or balls or rods of regular or irregular shapes that are in different tones of a color or colors to enhance visual identification of the sizes in the diameter or the shape or of the serial numbers in relation to their positions in the set in play.

Another preferred embodiment provides a set of specifically designed rings or disks or balls or rods of regular or irregular shapes in each of which is included an identification device such as an electronic chip, or a RF (radio frequency) tag or a magnetic strip or a bar code or other means capable to identify itself individually based on its size or shape or serial number in relation to its position in the set in play to the identification tracking devices incorporated at the two relevant specifically designed stations, one that it has vacated and the other that is receiving it, or may be equipped with its own device to transmit the information to an identification tracking devices of the two relevant specifically designed stations, one that it has vacated and the other that is receiving it, by means such as wireless radio wave, etc.

Another preferred embodiment provides a set of specifically designed rings or disks or balls or rods of regular or irregular shapes that are articles from existing established sports such as footballs (soccer), basket balls, hand balls (Olympic handball, Team handball), net balls, rugby balls, golf balls, water polo balls, hockey balls and pucks, polo balls, arrows (of archery), darts, relay batons, but not limited to these, and each of these articles is specifically incorporated with identification device such as an electronic chip, or a RF (radio frequency) tag or a magnetic strip or a bar code or other means based on the ascending order of serial numbers to identify itself in relation to its position in the set in play to the identification tracking devices incorporated at the two relevant specifically designed stations, one that it has vacated and the other that is receiving it, and these articles are made visually identifiable of the ascending order of the serial number in relation to its position in the set in play by the marked serial numbers, by the different colors or the different tones of a color or colors.

Another preferred embodiment provides, for moving a set of specifically designed rings or disks or balls or rods of regular or irregular shapes that are articles from existing established sports such as golf balls, polo balls, hockey balls (pucks), arrows (of archery), but not limited to these, and each of these articles is specifically incorporated with identification device such as an electronic chip, or a RF (radio frequency) tag or a magnetic strip or a bar code or other means based on the ascending order of serial numbers to identify itself in relation to its position in the set to the identification tracking devices incorporated at the two relevant specifically designed stations, one that it has vacated and the other that is receiving it, and these articles are made visually identifiable of the ascending order by the marked serial numbers, the different colors or the different tones of a color or colors, the means for moving or delivering these articles which are being moved or delivered by players from one specifically designed station to another, and which are the means as practiced in the relevant existing established sport, but not limited to this.

Another preferred embodiment provides, for moving a set of specifically designed hockey balls or pucks relating to the existing hockey sport and each of which is specifically incorporated with an identification device such as an electronic chip, or a RF (radio frequency) tag or a magnetic strip or a bar code or other means based on the ascending order of serial numbers to identify itself in relation to its position in the set to the identification tracking devices incorporated at the two relevant specifically designed stations, one that it has vacated and the other that is receiving it, and these hockey balls are made visually identifiable of the ascending order by the marked serial numbers, the different colors or the different tones of a color, the means to deliver the specifically designed hockey balls by players from one specifically designed station to another, which is by the hockey sticks used in the current established sport, but not limited to this.

Another preferred embodiment provides, for moving a set of specifically designed arrows relating to the existing archery sport and each of which is specifically incorporated with an identification device such as an electronic chip, or a RF (radio frequency) tag or a magnetic strip or a bar code or other means based on the ascending order of serial numbers to identify itself in relation to its position in the set to the identification tracking devices incorporated at the two relevant specifically designed stations, one that it has vacated and the other that is receiving it, and these arrows are made visually identifiable of the ascending order by the marked serial numbers, the different colors or the different tones of a color, the means to deliver the specifically designed arrows by players from one specifically designed station to another, which is by the bow used in the current established sport, but not limited to this.

Another preferred embodiment provides, for moving a set of specifically designed golf balls relating to the existing golf sport and each of which is specifically incorporated with an identification device such as an electronic chip, or a RF (radio frequency) tag or a magnetic strip or a bar code or other means based on the ascending order of serial numbers to identify itself in relation to its position in the set to the identification tracking devices incorporated at the two relevant specifically designed stations, one that it has vacated and the other that is receiving it, and these golf balls are made visually identifiable of the ascending order by the marked serial numbers, the different colors or the different tones of a color, the means to deliver the specifically designed golf balls by players from one specifically designed station to another, which is by the golf clubs used in the current established sport, but not limited to this.

Another preferred embodiment provides three specifically designed stations at each of which a set of any number of the specifically designed rings or disks or balls or rods of regular or irregular shapes can be physically stacked or placed in full set or in any partial numbers of the set.

Another preferred embodiment provides three specifically designed stations, at each of which a set of any number of the specifically designed rings or disks or balls or rods of regular or irregular shapes can be physically stacked or placed in full set or in any partial numbers of the set, that are place-able at a pre-determined distance, designated as 'L', between one another; typical distances between the three specifically designed stations are from five meters to fifteen meters for general throwing and catching games, but not limited to this, or a set of fixed ratios of the width or length of the relevant standard playground for current established sport games such as basket ball, net ball, hand ball (Olympic handball or Team handball), water polo, rugby, football (soccer), hockey, golf, archery, polo, athletics, etc.

Another preferred embodiment provides three specifically designed stations of one type on which a set of any number of the specifically designed rings or disks or balls or rods of regular or irregular shapes can be physically stacked or placed in full set or in any partial numbers of the set in ascending order of the sizes in the diameter or the shape or of the serial numbers from the top to the bottom. This type is the vertically stackable type, where the largest of the rings or disks or balls or rods of regular or irregular shapes will be put or placed first followed by others in descending order of sizes or shape or serial numbers. The three specifically designed stations can each have a center rod of straight diameter for the specifically designed rings or disks or balls type with equal diameter center holes to slide onto, or the center rod may have a cone shape so that a particular specifically designed ring or disk of the type with cone shape center hole of a particular size, can only be located, related to its serial position in a set, at a particular location on the cone shape center rod, at the matching taper of cone shape center hole and the taper part of the cone shape center rod. The matching location on the cone shape center rod will have the same color as that of the matching specifically designed ring or disk or balls; these fixed locations of the specifically designed rings or disks or balls on the cone shape center rods of the specifically designed stations with matching colors serve to enhance visual identification.

Another preferred embodiment provides three specifically designed stations of another type on which a set of any number of the specifically designed rings or disks or balls or rods of regular or irregular shapes can be physically stacked or placed in full set or in any partial numbers of the set from the right to the left in ascending order of the sizes in the diameter or the shape or the serial numbers. This type is the horizontally stackable type where the one of the smallest size or lowest serial number will at the right-most.

Another preferred embodiment provides three specifically designed stations furnished with individual slots or spaces, at each of the slots or spaces the relevant specifically designed ring or disk or ball or rod of regular or irregular shapes of a set can be physically placed and stacked, in full set or in any partial numbers of the set from the top to the bottom or from the right to the left in ascending order of the sizes in the diameter or the shape or of the serial numbers. The individual slots are of the same shape or feature and the same size for those specifically designed rings or disks or balls or rods of the same shape or feature and the same sizes that are articles from existing established sports such as basket ball, net ball, hand ball (Olympic handball or Team handball), water polo, rugby, football (soccer), hockey, golf, archery, polo, athletics, etc.

Another preferred embodiment provides three specifically designed stations furnished with individual slots, at each of the slots the relevant specifically designed ring or disk or ball or rod of regular or irregular shape from a set of rings or disks or balls or rods of regular or irregular shapes can be physically placed or stacked, in full set or in any partial numbers of the set from the top to the bottom or from the right to the left in ascending order of the sizes in the diameter or the shape or of the serial numbers, and these individual slots are made visually identifiable of the ascending order in relation to its position in the set in play by the marked serial numbers, the different colors or the different tones of a color or colors.

Another preferred embodiment provides three specifically designed stations with individual station designation identifiable by basic colors, the first one of which is designated the Original Station and the basic color of it is blue, the second one of which is designated the Interim Station and the basic color of it is yellow and the third one of which is designated the Final Station, the basic color of it is green.

Another preferred embodiment provides three specifically designed stations in each of which is included a device, electronic or otherwise, which is capable of identifying its own individual station designation, for instance, an Original Station, and of transmitting this information, or any other specific instructed information, to a specifically designed central control unit device, by means such as wireless radio wave, wire cable, etc.

Another preferred embodiment provides three specifically designed stations in each of which is included a device, electronic or otherwise, that is capable of reading and identifying the individual identification of the specifically designed ring or disk or ball or rod of regular or irregular shapes that is being received and stacked on, or removed from, the individual specifically designed station itself, and capable of transmitting this information to a specifically designed central control unit device, by means such as wireless radio wave, wire cable, etc.

Another preferred embodiment provides three specifically designed stations in each of which is included an electronic device and three lamps in three different colors of blue, green and red, that this electronic device is capable of lighting up the lamps as per instruction transmitted from the specifically designed central control unit device by means of wireless radio wave, wire cable, etc. Typical types of lamps are of electric, LED, LCD, but not limited to these.

Another preferred embodiment provides three specifically designed stations in each of which is included an audio sound speaker device, which is capable of producing specific sounds per instruction transmitted from the specifically designed central control unit device, by means such as wireless radio wave, wire cable, etc.

Another preferred embodiment provides the three specifically designed stations in each of which is included a power on-off switch and its own power source or cables to connect to an external power source.

Another preferred embodiment provides a set of specifically designed rings or disks or balls or rods of regular or irregular shapes, three specifically designed stations, a specifically designed central control unit and a display unit, the three specially designed stations being capable of accommodating the set of specifically designed rings or disks or balls or rods of regular or irregular shapes in full set or in any partial numbers of the set, and the set of specifically designed rings or disks or balls or rods of regular or irregular shapes first stacked or placed at the Original Station of the three specifically designed stations, capable of being moved and finally stacked at the Final Station, including using the Interim Station during the moves, and in any sequence of using the three specifically designed stations during the moves, by moving, throwing and catching or passing, points or goals being scored at the end of each move, and then stacking or placing the specifically designed rings or disks or balls or rods of regular or irregular shapes, one specifically designed ring or disk or ball or rod at a time, from one specifically designed station to another specifically designed station at a time, by three persons who are stationed one person each at the three specifically designed stations placed at a pre-determined distance 'L' from one another, and the three specially designed stations being capable of identifying the moves of the specifically designed rings or disks or balls or rods of regular or irregular shapes and transmitting to a specifically designed central control unit the movements of these specifically designed rings or disks or balls or rods being moved by the players by throwing and catching or passing, scoring points or goals at the end of each move, and being placed or stacked; the specially designed central control unit capable to process the information on moves, to give instructions to the three specially designed stations and the display unit; the display unit capable of displaying the information per instruction by the specially designed central control unit. The game played by three persons is designated Player Mode 'T', and when the same game played by a group of persons more than three or groups of three players, and taking turns to play by stationing themselves one at each of the specifically designed stations, is designated Player Mode 'G', and 'GT' respectively.

Another preferred embodiment provides a set of specifically designed rings or disks or balls or rods of regular or irregular shapes, three specifically designed stations, a specifically designed central control unit and a display unit, the three specially designed stations being capable of accommodating the set of specifically designed rings or disks or balls or rods of regular or irregular shapes, in full set or in any partial numbers of the set, and the set of specifically designed rings or disks or balls or rods of regular or irregular shapes first stacked at the Original Station of the three specifically designed stations, capable of being moved, points or goals being scored at the end of each move, and finally stacked or placed at the Final Station, including using the Interim Station during the moves, and in any sequence of using the three specifically designed stations during the moves, by taking out, carrying, scoring points or goals at the end of each move, and then stacking the rings or disks or balls or rods of regular or irregular shapes, one specifically designed ring or disk or ball or rod at a time, from one specifically designed station to another specifically designed station at a time, by one person who moves around between the three specifically designed stations placed at a predetermined distance 'L' from one another, and the three specially designed stations being capable of identifying the moves of the specifically designed rings or disks or balls or rods of regular or irregular shapes and the moves of the solo player, and capable of transmitting to the specifically designed central control unit the movements of these specifically designed rings or disks or balls or rods being moved and stacked or placed by the solo player, and the moves of the solo player; the specially designed central control unit capable to process the information on moves, to give instructions to the three specially designed stations and the display unit; the display unit capable of displaying the information per instruction by the central control unit. The game played by a solo person is designated Player Mode 'S'. When the same game is played by a group of persons and taking turns to play in solo, is designated Player Mode 'GS'. For this player mode where the player moves with the specifically designed ring or disk under move, three players can play with one of the three players moving with the one specifically designed ring or disk or ball or rod of regular or irregular shape that is being moved, one player and one specifically designed ring or disk or ball or rod of regular or irregular shape at a time, by carrying it, for example, for baton relay type of game. This is designated Player Mode 'TR', and 'GTR' for the case of a group of three players, and the Game Mode for the relay type is designated Game Mode 'RR'.

Another preferred embodiment provides a set of specifically designed rings or disks or balls or rods of regular or irregular shapes, three specifically designed stations, a specifically designed central control unit, a specifically designed playground (field, pitch) and a display unit; the three specially designed stations being capable of accommodating the set of specifically designed rings or disks or balls or rods of regular or irregular shapes, in full set or in any partial numbers of the set; and the set of specifically designed rings or disks or balls or rods of regular or irregular shapes first stacked at the Original Station of the three specifically designed stations, capable of being moved and finally stacked or placed at the Final Station, including using the Interim Station during the moves, and in any sequence of using the three specifically designed stations during the moves, by taking out, moving, carrying and/or passing, shooting goals or scoring points, and then stacking or placing the rings or disks or balls or rods of regular or irregular shapes, one specifically designed ring or disk or ball or rod at a time, from one specifically designed station to another specifically designed station at a time, by two persons in competition to each other, or a group of persons in two teams in competition to each team, who moves around between the three specifically designed stations placed at a pre-determined distance 'L' from one another on the specifically designed playground (field, pitch), and playing according to the relevant competition rules of relevant established sports such as basket ball, net ball, hand ball (Olympic handball or Team handball), water polo, rugby, football (soccer), hockey, polo, etc., but not limited to this, and the three specially designed stations being capable of identifying the moves of the specifically designed rings or disks or balls or rods of regular or irregular shapes and transmitting to a specifically designed central control unit the movements of these specifically designed rings or disks or balls or rods being moved, goals or points scored and stacked or placed by the players in competition; the specifically designed central control unit capable to process the information on moves, to give instructions to the three specially designed stations and the display unit; the display unit capable of displaying the information per instruction by the specifically designed central control unit. The game played in this player mode of competition by two individuals is designated Player Mode 'CS' and by two teams is designated Player Mode 'CT'.

Another preferred embodiment provides three specifically designed stations incorporated with the specifically designed means or equipment to be used by a solo player or group or teams of players to facilitate the moving, passing, receiving, scoring goals or points, and stacking or placing a set of specifically designed rings or disks or balls or rods of regular or irregular shapes that are articles from the existing established sports, such as basket ball, net ball, hand ball (Olympic handball or Team handball), water polo, rugby, football (soccer), hockey, golf, archery, polo, athletics, etc. but not limited to these, and are incorporated with identification devices such as an electronic chip, or a RF (radio frequency) tag or a magnetic strip or a bar code or other means based on the ascending order of serial numbers, and made visually identifiable of the ascending order by the marked serial numbers, the different colors or the different tones of a color or colors, in relation to its position in the set in play, and these incorporated specifically designed means or equipment such as goals, goal posts, goal lines, playgrounds (fields, pitches), are with relevance in design and use to the corresponding existing established sports.

Another preferred embodiment provides the specifically designed playground (field, pitch) to be used by a solo player or group or teams of players to facilitate the moving, passing, receiving, scoring goals or points, and stacking or placing a set of specifically designed rings or disks or balls or rods of regular or irregular shapes that are articles from the existing established sports, such as basket ball, net ball, hand ball (Olympic handball or Team handball), water polo, rugby, football (soccer), hockey, golf, archery, polo, athletics, etc. but not limited to these, and are incorporated with identification devices such as an electronic chip, or a RF (radio frequency) tag or a magnetic strip or a bar code or other means based on the ascending order of serial numbers, and made visually identifiable of the ascending order by the marked serial numbers, the different colors or the different tones of a color or colors, in relation to their positions in the set in play, and these specifically designed playgrounds (fields, pitches) each accommodates the three specifically designed stations-cum-goals or goalposts or goal lines and have boundaries preferably of circular shape, hexagonal shape, regular hexagonal shape, equilateral triangle shape, to meet the feature and the functional requirements for inclusion of the three goals or goalposts or goal lines, but may also have rectangular or square shape, and which are constructed relevant to the established sport to be played, such as the construction of the play ground floor, field or pitch.

Another preferred embodiment provides three specifically designed stations incorporated with specially designed golf putting greens and three putting holes, natural or artificial, but not limited to this, to be used by a solo player or players to facilitate the putting, receiving and stacking or placing a set of specifically designed golf balls that are articles from the existing golf sport, and are incorporated with identification devices such as an electronic chip, or a RF (radio frequency) tag or a magnetic strip or a bar code or other means based on the ascending order of serial numbers, and made visually identifiable of the ascending order by the marked serial numbers, and by the different colors or the different tones of a color or colors, in relation to their position in the set.

Another preferred embodiment provides three specifically designed stations incorporated with specially designed golf chipping grounds, natural or artificial, but not limited to this, to be used by a solo player or players to facilitate the chipping of the specifically designed golf balls onto greens and followed up by putting, receiving and stacking a set of specifically designed golf balls that are articles from existing golf sport, and are incorporated with identification devices such as an electronic chip, or a RF (radio frequency) tag or a magnetic strip or a bar code or other means based on the ascending order of serial numbers, and made visually identifiable of the ascending order by the marked serial numbers, and by the different colors or the different tones of a color or colors, in relation to their position in the set.

Another preferred embodiment provides three specifically designed stations incorporated with specifically designed archery targets, with standard concentric circles to be used by a solo player or players to facilitate the shooting, receiving and stacking a set of specifically designed archery arrows that are articles from the existing archery sport, and are incorporated with identification devices such as an electronic chip, or a RF (radio frequency) tag or a magnetic strip or a bar code or other means based on the ascending order of serial numbers, and made visually identifiable of the ascending order by the marked serial numbers, and by the different colors or the different tones of a color or colors, in relation to their position in the set.

Another preferred embodiment provides the specifically designed playing ground (field, pitch) with circular boundary which is circumscribed by an imaginary equilateral triangle, for playing the established sport game types of basket ball, net ball, football (soccer), hand ball (Olympic handball or Team handball), hockey, water polo, but not limited to these, the length of each of the three imaginary sides of the equilateral triangle of the specifically designed playground is set within a range of fixed lengths, including 1 time and 1.15 times the width of the current playground of the respective established sport game type, but not limited to this, and at each of the three vertices of the imaginary equilateral triangle, a specifically designed goal post incorporated with one of the three specifically designed stations is positioned in the specifically designed playground (field, pitch), the floor of which is constructed per the standard materials used for the established current relevant sport.

Another preferred embodiment provides the specifically designed playing ground (field, pitch), which is in regular hexagonal shape circumscribed by an imaginary equilateral triangle, for playing the established sport game types of basket ball, net ball, football (soccer), hand ball (Olympic handball or Team handball), hockey, water polo, but not limited to these, with the three vertices of the imaginary equilateral triangle touching at the midpoint of the three alternate sides of the regular hexagon, the length of each of the three imaginary sides of the equilateral triangle is set within a range of fixed lengths, including 1 time and 1.15 times the width of the current playground of the respective established sport game type, but not limited to this, and at each of the three vertices of the imaginary equilateral triangle, a specifically designed goal post incorporated with one of the three specifically designed stations is positioned in the specifically designed playground (field, pitch), the floor of which is constructed per the standard materials used for the established current relevant sport.

Another preferred embodiment provides the specifically designed playing ground (field, pitch) which is in the hexagonal shape (not regular hexagon shape) for playing the established sport game types of basket ball, net ball, football (soccer), hand ball (Olympic handball or Team handball), hockey, water polo, but not limited to these, the lengths of the three alternates sides of the hexagon shape playground that do not have the goals or goal posts can be equally longer that the lengths of the three alternate sides of the hexagonal shape playground that have at the midpoints the three goals or goal posts incorporated with the three specifically designed stations; this is to provide a specifically designed playground (field, pitch) with a variation of the floor space, the floor of which is constructed per the standard materials used for the established current relevant sport.

Another preferred embodiment provides the specifically designed playing ground (field, pitch) in regular hexagon shape, for playing the established sport game types of rugby, but not limited to this, that the length of each of the six sides of the regular hexagon shape specifically designed playground is set within a range of fixed lengths, including 0.57 times and 1 times the width of the current playground of the respective established sport game type, but not limited to this, that the three goal lines are the three alternate sides of the six sides of the regular hexagon, and at the midpoint of each of the three goal lines a specifically designed goal post incorporated with one of the three specifically designed stations is positioned in the specifically designed playground (field, pitch), the other three alternate sides of the regular hexagon are the touchlines, the floor of the specifically designed playground (field, pitch) is constructed per the standard materials used for the established current relevant sport. Three in-goal areas of appropriate size are added from the goal lines (include goal lines) to the outside of the goal lines.

Another preferred embodiment provides three specifically designed stations incorporated with three specifically designed basketball back boards with goal posts and nettings, one at each vertex of the imaginary equilateral triangle of the specifically designed basket ball playing ground with circular boundary circumscribed by an imaginary equilateral triangle, to be used by a solo player or a group of players to facilitate the moving or passing, shooting, receiving and stacking or placing a set of specifically designed basketballs that are articles from the existing basketball sport, and are incorporated with identification devices such as an electronic chip, or a RF (radio frequency) tag or a magnetic strip or a bar code or other means based on the ascending order of serial numbers, and made visually identifiable of the ascending order by the marked serial numbers, and by the different colors or the different tones of a color or colors, in relation to their positions in the set.

Another preferred embodiment provides three specifically designed stations incorporated with three specifically designed net ball goal posts, rings and nettings, one at each vertex of the imaginary equilateral triangle of the specifically designed net ball playing ground with circular boundary which is circumscribed by an imaginary equilateral triangle, to be used by a group of players to facilitate the moving or passing, shooting, receiving and stacking or placing a set of specifically designed net balls that are articles from the existing net ball sport, and are incorporated with identification devices such as an electronic chip, or a RF (radio frequency) tag or a magnetic strip or a bar code or other means based on the ascending order of serial numbers, and made visually identifiable of the ascending order by the marked serial numbers, and by the different colors or the different tones of a color or colors, in relation to their positions in the set.

Another preferred embodiment provides three specifically designed stations incorporated with three specifically designed hand ball (Olympic handball or Team handball) goal posts with nettings, one at each vertex of the imaginary equilateral triangle of the specifically designed hand ball playing ground with circular boundary circumscribed by an imaginary equilateral triangle, to be used by a group of players to facilitate the moving or passing, shooting, receiving and stacking or placing a set of specifically designed hand balls that are articles from the established existing hand ball (Olympic handball or Team handball) sport, and are incorporated with identification devices such as an electronic chip, or a RF (radio frequency) tag or a magnetic strip or a bar code or other means based on the ascending order of serial numbers, and made visually identifiable of the ascending order by the marked serial numbers, and by the different colors or the different tones of a color or colors, in relation to their positions in the set.

Another preferred embodiment provides three specifically designed stations incorporated with three specifically designed football (soccer) goal posts with nettings, one at each vertex of the imaginary equilateral triangle at the specifically designed football (soccer) playing ground (field, pitch) with circular boundary circumscribed by an imaginary equilateral triangle, to be used by a group of players to facilitate the moving or passing, shooting, receiving and stacking a set of specifically designed footballs that are articles from the established existing football sport, and are incorporated with identification devices such as an electronic chip, or a RF (radio frequency) tag or a magnetic strip or a bar code or other means based on the ascending order of serial numbers, and made visually identifiable of the ascending order by the marked serial numbers, and by the different colors or the different tones of a color or colors, in relation to their positions in the set.

Another preferred embodiment provides three specifically designed stations incorporated with three specifically designed hockey goal posts with nettings, one at each vertex of the imaginary equilateral triangle, at the specifically designed hockey playing ground (field) with circular boundary circumscribed by an imaginary equilateral triangle, to be used by a group of players to facilitate the moving or passing, shooting, receiving and stacking a set of specifically designed hockey balls or pucks that are articles from the established existing hockey ball sport, and are incorporated with identification devices such as an electronic chip, or a RF (radio frequency) tag or a magnetic strip or a bar code or other means based on the ascending order of serial numbers, and made visually identifiable of the ascending order by the marked serial numbers, and by the different colors or the different tones of a color or colors, in relation to their positions in the set.

Another preferred embodiment provides three specifically designed stations incorporated with three specifically designed rugby ball goal posts and three goal lines, one at each alternate sides of the hexagonal boundary lines of the specially designed rugby playing ground (field, pitch) with regular hexagon shape boundary, and the three goal posts positioned at the midpoint of the three goal lines, to be used by a group of players to facilitate the moving or passing, shooting, receiving and stacking or placing a set of specifically designed rugby balls that are articles from the established existing rugby ball sport, and are incorporated with identification devices such as an electronic chip, or a RF (radio frequency) tag or a magnetic strip or a bar code or other means based on the ascending order of serial numbers, and made visually identifiable of the ascending order by the marked serial numbers, and by the different colors or the different tones of a color or colors, in relation to their positions in the set.

Another preferred embodiment provides three specifically designed stations incorporated with three specifically designed water polo ball goal posts with nettings, one at each vertex of the imaginary equilateral triangle of the specifically designed swimming pool with circular boundary circumscribed by an imaginary equilateral triangle, to be used by a solo player or players to facilitate the moving or passing, shooting, receiving and stacking or placing a set of specifically designed water polo balls that are articles from the established existing water polo sport, and are incorporated with identification devices such as an electronic chip, or a RF (radio frequency) tag or a magnetic strip or a bar code or other means based on the ascending order of serial numbers, and made visually identifiable of the ascending order by the marked serial numbers, and by the different colors or the different tones of a color or colors, in relation to their positions in the set.

Another preferred embodiment provides the specifically designed goal posts in round shape or in rectangular shape as relevant for playing the sport game types of football, hand ball, hockey, water polo, but not limited to these, which are the type of established games that normally have particular goal defenders or goalkeepers positioned at the goalposts, that the inside diameter of the round shape or the internal sides of the rectangle shape of each of the three specifically designed goal posts is between two to four times the diameter of the current ball of the respective established sport game type but not limited to this, and which have sensors, electronic or otherwise, capable to detect and determine that a goal has been scored, and capable to determine the ID of the specifically designed ball that scored the goal. There are no particular goal defenders or goalkeepers positioned at the goal posts for this embodiment of the game of invention; there is only one of this specifically designed goal post at each vertex of the imaginary triangle and coupled to a specifically designed station positioned at the vertex.

Another variation of the preferred embodiment provides, for playing the sport game types of football, hand ball, hockey, water polo, but not limited to these, which are the type of established games that normally have particular goal defenders or goalkeepers positioned at the goalposts, two standard goalposts relevant to the sport in play at each of the three vertexes of the imaginary triangle, side by side and one meter apart, both coupled to the one specifically designed station of that vertex, one goalpost guarded by a goalkeeper from one side of the two competing teams, the other goalpost guarded by a goalkeeper from the other side of the two competing teams, each goal keeper fending off any goal going into his/her post he/she is defending. There will be six standard goalposts and six goalkeepers, three from each competing team, on the playground during play.

Another preferred embodiment provides a specifically designed central control unit device which has an electronic processing device capable of receiving the information transmitted from the three specifically designed stations for further processing and managing, the information being transmitted by means of wireless radio waves or wire cable.

Another preferred embodiment provides a specifically designed central control unit device which has an electronic processing device capable of processing the information transmitted from any of the three specifically designed stations and checking the set up at the start of a new game that a set of specifically designed rings or disks or balls or rods of regular or irregular shapes are properly stacked or placed in full set in ascending order of size or shape or in serial number from the top to bottom or from the right to left at the Original Station, that the other two specifically designed stations, namely the Interim Station and the Final Station, do not have any specifically designed ring or disk or ball or rod of regular or irregular shapes, and determining the number of specifically designed rings or disks or balls or rods of regular or irregular shapes, which is designated as 'n', in the full set to be played, and when confirmed that the set up is properly done, to transmit this information to the display unit to indicate the game set up is correct, the information being transmitted by means of wireless radio waves or wire cable.

Another preferred embodiment provides a specifically designed central control unit device which has an electronic processing device capable of processing the information transmitted from any of the three specifically designed stations on the movement of the specifically designed rings or disks or balls or rods of regular or irregular shapes from one specifically designed station to another, and determining whether the specifically designed ring or disk or ball or rod of regular or irregular shapes being moved follows the first game rule of moving one specifically designed ring or disk or ball or rod of regular or irregular shapes at a time, and from one specifically designed station to another specifically designed station at a time and stacked or placed.

Another preferred embodiment provides a specifically designed central control unit device which has an electronic processing device capable of processing the information transmitted from any of the three specifically designed stations on the movement of the specifically designed rings or disks or balls or rods of regular or irregular shapes from one specifically designed station to another, and determining whether the specifically designed ring or disk or ball or rod of regular or irregular shapes being moved follows the second game rule of it being smaller in size or shape or in serial number than the specifically designed ring or disk or ball or rod of regular or irregular shapes under it or on the left of it before the move and under it or on the left of it after the move and stacked or placed on one of the specifically designed stations, relevant to the two types of specifically designed stations whether stacked or placed from the top to the bottom (vertical stacking type) or from the right to the left (horizontal stacking type) in ascending order, in the case any of the specifically designed two stations involved in this move already has one or more specifically designed rings or disks or balls or rods of regular or irregular shapes under or on the left of the specifically designed ring or disk or ball or rod of regular or irregular shapes being moved, and this processing feature capability can be turned on or off as per choice.

Another preferred embodiment provides a specifically designed central control unit device which has an electronic processing device capable of transmitting any processed information or instruction to the relevant one or to all of the three specifically designed stations, by means of wireless radio waves or wire cable.

Another preferred embodiment provides a specifically designed central control unit device which has an electronic processing device capable of transmitting any processed information or instruction to a display unit, by means of wireless radio waves or wire cable.

Another preferred embodiment provides a specifically designed central control unit device which has an electronic processing device capable of processing the information transmitted from any of the three specifically designed stations on the movement of the specifically designed rings or disks or balls or rods of regular or irregular shapes from one specifically designed station to another, and determining whether the specifically designed ring or disk or ball or rod of regular or irregular shapes being moved is following the first game rule of moving one specifically designed ring or disk or ball or rod of regular or irregular shapes at a time, and from one specifically designed station to another specifically designed station at a time, and if the move is correct, the specifically designed central control unit device will continue to the next stage of processing; if the move is incorrect, to transmit to the relevant vacating specifically designed station and receiving specifically designed stations the instruction to put on the red lights and to make the alarm audio sound of in-correctness for a specific period of time, the instruction being transmitted by means of wireless radio waves or wire cable.

Another preferred embodiment provides a specifically designed central control unit device which has an electronic processing unit capable of, after processing the received information on the move of the specifically designed ring or disk or ball or rod of regular or irregular shapes being moved and stacked or placed, whether the move is following the second game rule that the moved specifically designed ring or disk or ball or rod of regular or irregular shapes is smaller in size or shape or in serial number than the specifically designed ring or disk or ball or rod of regular or irregular shapes under it or on the left of it before the move and under it or on the left of it after the move, relevant to the two types of specifically designed stations whether stackable from the top to the bottom in ascending order (vertical stackable type) or from the right to the left in ascending order (horizontal stackable type), in the case any of the two specifically designed stations involved in this move has one or more specifically designed rings or disks or balls or rods of regular or irregular shapes under or on the left of the specifically designed ring or disk or ball or rod of regular or irregular shapes being moved, and if the move is correct, transmitting to the relevant receiving specifically designed station the instruction to put the green light on and to make the correct audio sound for a short designated period; if the move is incorrect, to put on the red light and to make the alarm audio sound of in-correctness for a specific period of time, the instruction being transmitted by means of wireless radio waves or wire cable.

Another preferred embodiment provides a specifically designed central control unit device which has an electronic processing device capable of computing the mathematical formula:

$$\text{'}m=(2^n-1)\text{'} \qquad \text{Equation 1}$$

where

'n' is the number of specifically designed rings or disks or balls or rods of regular or irregular shapes in a set to be played or moved, 'm' is the minimum number of moves possible for moving the whole set of 'n' numbers of the specifically designed rings or disks or balls or rods of regular or irregular shapes from the Original Station to the Final Station using the Interim station during the moves, when played according to the said two game rules.

The quantity 'n' is determined from the transmitted information from the Original Station to the specifically designed central control unit device at the start of a new game, and the specifically designed central control unit device is capable to transmit this information to the display unit for displaying the numbers for 'm' and 'n', by means of wireless radio waves or wire cable.

Another preferred embodiment provides a specifically designed central control unit device which has an electronic processing device capable of computing the actual number of moves designated 'M' being made by the specifically designed rings or disks or balls or rods of regular or irregular shapes as the specifically designed rings or disks or balls or rods of regular or irregular shapes are being moved from one specifically designed station to another and with the specifically designed stations transmitting the information of each of these moves to the specifically designed central control unit device, and the specifically designed central control unit device being capable to transmit to the electronic display unit for displaying the actual number of moves 'M', by means of wireless radio waves or wire cable.

Another preferred embodiment provides a specifically designed central control unit device which has an electronic processing device capable of computing the 'AmkRINGS Algorithm', as described in Table 1 below, of the necessary step by step sequence of movement of the specifically designed rings or disks or balls or rods of regular or irregular shapes to any of the three specifically designed stations to achieve minimum number of moves 'm' possible for a given number 'n' of specifically designed rings or disks or balls or rods of regular or irregular shapes in a set being moved completely from the Original specifically designed station to the Final specifically designed station using the Interim specifically designed station during the moves, and when played according to the said two game rules, and this processing capability feature can be turned on or off as per choice. The step by step sequence process in the said table shows up to 12 specifically designed rings or disks for 'n' and the step by step sequence can continue up to any higher number 'x' of the specifically designed rings or disks or balls or rods of regular or irregular shapes.

If the number 'n' of the specifically designed rings or disks or balls or rods of regular or irregular shapes in the set in play is an even number, the columns for the Interim Station and the Final Station in upper block is to be applicable, whereupon the very first specifically designed ring or disk or balls or rods of regular or irregular shapes in the set in play is moved to the Interim Station first at the start of the game.

If the number 'n' of the specifically designed rings or disks or balls or rods of regular or irregular shapes in the set in play is an odd number, the columns for the Interim Station and the Final Station in lower block is to be applicable, whereupon the very first specifically designed ring or disk or balls or rods of regular or irregular shapes in the set in play is moved to the Final Station first at the start of the game.

TABLE 1

AmkRINGS Algorithm
Step by Step Method of Moves

| NO. OF LAYER n | MOVE NO. m | ORIGINAL STATION | INTERIM STATION (EVEN NO. OF n) FINAL STATION (ODD NO. OF n) | FINAL STATION (EVEN NO. OF n) INTERIM STATION (ODD NO. OF n) |
|---|---|---|---|---|
| 3 | 0 | 1~x | — | — |
| | 1 | 2~x | 1 | — |
| | 2 | 3~x | 1 | 2 |
| | 3 | 3~x | — | 1, 2 |
| | 4 | 4~x | 3 | 1, 2 |

TABLE 1-continued

| AmkRINGS Algorithm Step by Step Method of Moves | | | | |
|---|---|---|---|---|
| NO. OF LAYER n | MOVE NO. m | ORIGINAL STATION | INTERIM STATION (EVEN NO. OF n) FINAL STATION (ODD NO. OF n) | FINAL STATION (EVEN NO. OF n) INTERIM STATION (ODD NO. OF n) |
| | 5 | 1, 4~x | 3 | 2 |
| | 6 | 1, 4~x | 2, 3 | — |
| | 7 | 4~x | 1, 2, 3 | — |
| 4 | 8 | 5~x | 1, 2, 3 | 4 |
| | 9 | 5~x | 2, 3 | 1, 4 |
| | 10 | 2, 5~x | 3 | 1, 4 |
| | 11 | 1, 2, 5~x | 3 | 4 |
| | 12 | 1, 2, 5~x | — | 3, 4 |
| | 13 | 2, 5~x | 1 | 3, 4 |
| | 14 | 5~x | 1 | 2, 3, 4 |
| | 15 | 5~x | — | 1, 2, 3, 4 |
| 5 | 16 | 6~x | 5 | 1, 2, 3, 4 |
| | 17 | 1, 6~x | 5 | 2, 3, 4 |
| | 18 | 1, 6~x | 2, 5 | 3, 4 |
| | 19 | 6~x | 1, 2, 5 | 3, 4 |
| | 20 | 3, 6~x | 1, 2, 5 | 4 |
| | 21 | 3, 6~x | 2, 5 | 1, 4 |
| | 22 | 2, 3, 6~x | 5 | 1, 4 |
| | 23 | 1, 2, 3, 6~x | 5 | 4 |
| | 24 | 1, 2, 3, 6~x | 4, 5 | — |
| | 25 | 2, 3, 6~x | 1, 4, 5 | — |
| | 26 | 3, 6~x | 1, 4, 5 | 2 |
| | 27 | 3, 6~x | 4, 5 | 1, 2 |
| | 28 | 6~x | 3, 4, 5 | 1, 2 |
| | 29 | 1, 6~x | 3, 4, 5 | 2 |
| | 30 | 1, 6~x | 2, 3, 4, 5 | — |
| | 31 | 6~x | 1, 2, 3, 4, 5 | — |
| 6 | 32 | 7~x | 1, 2, 3, 4, 5 | 6 |
| | 33 | 7~x | 2, 3, 4, 5 | 1, 6 |
| | 34 | 2, 7~x | 3, 4, 5 | 1, 6 |
| | 35 | 1, 2, 7~x | 3, 4, 5 | 6 |
| | 36 | 1, 2, 7~x | 4, 5 | 3, 6 |
| | 37 | 2, 7~x | 1, 4, 5 | 3, 6 |
| | 38 | 7~x | 1, 4, 5 | 2, 36 |
| | 39 | 7~x | 4, 5 | 1, 2, 3, 6 |
| | 40 | 4, 7~x | 5 | 1, 2, 3, 6 |
| | 41 | 1, 4, 7 | 5 | 2, 3, 6 |
| | 42 | 1, 4, 7 | 2, 5 | 3, 6 |
| | 43 | 4, 7~x | 1, 2, 5 | 3, 6 |
| | 44 | 3, 4, 7~x | 1, 2, 5 | 6 |
| | 45 | 3, 4, 7~x | 2, 5 | 1, 6 |
| | 46 | 2, 3, 4, 7~x | 5 | 1, 6 |
| | 47 | 1, 2, 3, 4, 7~x | 5 | 6 |
| | 48 | 1, 2, 3, 4, 7~x | — | 5, 6 |
| | 49 | 2, 3, 4, 7~x | 1 | 5, 6 |
| | 50 | 3, 4, 7~x | 1 | 2, 5, 6 |
| | 51 | 3, 4, 7~x | — | 1, 2, 5, 6 |
| | 52 | 4, 7~x | 3 | 1, 2, 5, 6 |
| | 53 | 1, 4, 7~x | 3 | 2, 5, 6 |
| | 54 | 1, 4, 7~x | 2, 3 | 5, 6 |
| | 55 | 4, 7~x | 1, 2, 3 | 5, 6 |
| | 56 | 7~x | 1, 2, 3 | 4, 5, 6 |
| | 57 | 7~x | 2, 3 | 1, 4, 5, 6 |
| | 58 | 2, 7~x | 3 | 1, 4, 5, 6 |
| | 59 | 1, 2, 7~x | 3 | 4, 5, 6 |
| | 60 | 1, 2, 7~x | — | 3, 4, 5, 6 |
| | 61 | 2, 7~x | 1 | 3, 4, 5, 6 |
| | 62 | 7~x | 1 | 2, 3, 4, 5, 6 |
| | 63 | 7~x | — | 1, 2, 3, 4, 5, 6 |
| 7 | 127 | 8~x | 1, 2, 3, 4, 5, 6, 7 | — |
| 8 | 255 | 9~x | — | 1, 2, 3, 4, 5, 6, 7, 8 |
| 9 | 511 | 10~x | 1, 2, 3, 4, 5, 6, 7, 8, 9 | — |
| 10 | 1023 | 11~x | — | 1, 2, 3, 4, 5, 6, 7, 8, 9, 10 |
| 11 | 2047 | 12~x | 1, 2, 3, 4, 5, 6, 7, 8, 9, 10, 11 | — |
| 12 | 4095 | 13~x | — | 1, 2, 3, 4, 5, 6, 7, 8, 9, 10, 11, 12 |

Another preferred embodiment provides a specifically designed central control unit device which has the electronic processing capable of processing the transmitted information of the move from the relevant specifically designed stations, whether the step by step sequence of the specifically designed ring or disk or ball or rod of regular or irregular shapes being moved is in accordance with the step by step sequence as stated in 'AmkRINGS Algorithm', and capable of transmitting to the relevant specifically designed stations after each move, if the move is correct, to put the green light and the audio sound of correctness on for a short designated period, or if the move is incorrect, to put on the red light and the audio sound alarm of in-correctness for a short designated period of time, by means of wireless radio waves or wire cable.

Another preferred embodiment provides a specifically designed central control unit device which has the electronic processing device capable of processing the transmitted information from the relevant specifically designed stations of the moves of the specifically designed rings or disks or balls or rods of regular or irregular shapes, and calculating with reference to the formula '$m=(2^n-1)$' or the 'AmkRINGS Algorithm', the interim minimum move '$m^y$' possible for the interim number of the specifically designed rings or disks or balls or rods of regular or irregular shapes '$n^y$' already moved from the Original specifically designed station for the first time at that stage, at any stage of the game before the game reaches completion. This '$m^y$' will be equal to 'm' and '$n^y$' to 'n' at the completion of the game.

Another preferred embodiment provides a specifically designed central control unit device which has the electronic processing device capable of processing the transmitted information from the relevant specifically designed stations of the moves of the specifically designed rings or disks or balls or rods of regular or irregular shapes, and calculating with reference to the formula '$m=(2^n-1)$' or to the step by step sequence stated in the 'AmkRINGS Algorithm', the possible minimum number of moves 'p' a solo player playing in the mode designated Player Mode 'S', can make between the specially designed stations for any number of 'n' of the specifically designed rings or disks or balls or rods of regular or irregular shapes in play, when the three specifically designed stations are positioned at distances of 'L' between them, for games designated Game Mode 'PP', that require a solo player to carry and move with the specifically designed ring or disk or ball or rod of regular or irregular shapes whenever a move is made with the specifically designed ring or disk or ball or rod of regular or irregular shapes, by walking, jogging, riding, skating, swimming, etc., as examples using specifically designed water polo balls or specifically designed basketballs; the formula is:

$$'p=2m-1' \qquad \text{Equation 2}$$

where 'm' is the minimum possible number of moves made by the specifically designed rings or disks or balls or rods of regular or irregular shapes in a set in play.

Another preferred embodiment provides a player identification device which the specifically designed stations can track and transmit the information to the specifically designed central control unit, when a player equipped with the said player identification device personally makes a move between two of the three specifically designed stations which are placed at a pre-determined distance 'L', when the player is moving a specifically designed ring or disk or ball or rod of regular or irregular shapes during the game.

Another preferred embodiment provides a specifically designed central control unit device which has the electronic processing device capable of processing the transmitted information from the relevant specifically designed stations, of the moves of the specifically designed rings or disks or balls or rods of regular or irregular shapes, and of the moves of the solo player tracked from the player identification device, and counting the actual number of moves 'P' a solo player playing in the mode designated Player Mode 'S', makes between the specially designed stations for any number of 'n' of the specifically designed rings or disks or balls or rods of regular or irregular shapes in play, when the three specifically designed stations are positioned at distances of 'L' between them, for those games designated Game Mode 'PP', that require a solo player to carry and move with the specifically designed ring or disk or ball or rod of regular or irregular shapes whenever a move is made with the specifically designed ring or disk or ball or rod of regular or irregular shapes, by walking, jogging, riding, skating, swimming, etc., as examples using specifically designed water polo balls or specifically designed basketballs.

Another preferred embodiment provides a specifically designed central control unit device which has the electronic processing device capable of processing the transmitted information from the relevant specifically designed stations, of the moves of the specifically designed rings or disks or balls or rods of regular or irregular shapes, and of the moves of the solo player tracked from the player identification device, and counting the actual number of moves 'Q' a solo player playing in the mode designated Player Mode 'S', makes between the specially designed stations for any number of 'n' of the specifically designed rings or disks or balls or rods of regular or irregular shapes in play, when the three specifically designed stations are positioned at distances of 'L' between them, for those games, designated Game Mode 'QQ', that require a player to use a delivery means to move the specifically designed ring or disk or ball or rod of regular or irregular shapes between the specifically designed stations, for examples by using a golf club moving a specially designed golf ball or by using an archery bow for moving a specifically designed arrow, etc., and then the solo player moving between the specifically designed stations by walking, jogging, riding, etc.

Another preferred embodiment provides a specifically designed central control unit device which has the electronic processing device capable of processing the transmitted information from the relevant specifically designed stations which are placed at distances 'L' from one another, of the moves of the specifically designed rings or disks or balls or rods of regular or irregular shapes, and of the moves of the solo player tracked from the player identification device, and calculating the minimum possible distance 'd' and the actual distance 'D' covered by the solo player playing in the mode designated Player Mode 'S', by multiplying 'L' with 'p' and 'P' respectively for games designated Game Mode 'PP', that require a solo player to carry and move with the specifically designed ring or disk or ball or rod of regular or irregular shapes whenever a move is made with the specifically designed ring or disk or ball or rod of regular or irregular shapes, as examples using specifically designed water polo balls or specifically designed basket balls, and the solo player moving between the specifically designed stations by walking, jogging, riding, skating, swimming, etc., and calculating the time 'T' elapsed for the game, but not limited to these. For interval or session stopped game, the minimum moves '$m^{\nu}$', '$p^{\nu}$', the actual moves '$M_i$', '$P_i$', the distance '$d^{\nu}$', '$D_i$' and the time elapsed '$T_i$' relating to '$n^{\nu}$' at the interval are calculated.

Another preferred embodiment provides a specifically designed central control unit device which has the electronic processing device capable of processing the transmitted information from the relevant specifically designed stations which are placed at distances 'L' from one another, of the moves of the specifically designed rings or disks or balls or rods of regular or irregular shapes, and of the moves of the solo player tracked from the player identification device, and calculating the actual distance 'D' covered by the solo player playing in the mode designated Player Mode 'S', by multiplying 'L' with 'Q' for those games designated Game Mode 'QQ', that require a solo player to use a delivery means to move the specifically designed ring or disk or ball or rod of regular or irregular shapes between the specifically designed stations, for examples by using a golf club for moving a specially designed golf ball or by using an archery bow for moving a specifically designed arrow, etc., and then the solo player moving between the specifically designed stations by walking, jogging, riding, etc, and calculating the time 'T' elapsed for the game, but not limited to these. For interval or session stopped game, the minimum moves '$m^{\nu}$', the actual moves '$M_i$', '$Q_i$', the distance, '$D_i$' and the time elapsed '$T_i$' relating to '$n^{\nu}$' at the interval are calculated.

Another preferred embodiment provides a specifically designed central control unit device which has the electronic processing device capable of the game teaching mode according to the step by step sequence of moves as stated in the 'AmkRINGS Algorithm', by guiding with blue lighting signals of the relevant specifically designed stations, whereupon the correct vacating specifically designed station, from which to initiate the move and vacate the specifically designed ring or disk or ball or rod of regular or irregular shapes, will switch on the blue stable light at its blue lamp until the top or right-most specifically designed ring or disk or ball or rod of regular or irregular shapes is taken off, and the correct receiving specifically designed station for that move will switch on the blue light intermittently on its blue lamp until the said specifically designed ring or disk or ball or rod of regular or irregular shapes vacated from the said vacating specially designed station is received and stacked or placed from the top or at the right-most, relevant to the type of the specifically designed stations whether stackable from the top to the bottom or from the right to the left in ascending order, all the instructive information transmitted to the relevant specifically designed stations by means of wireless radio waves or wire cable.

Another preferred embodiment provides a specifically designed central control unit device which has an electronic processing device capable of the setting of three Modes of Play by choice, namely;

(1) the first mode, designate Play Mode A, is for processing the movements following the first game rule of moving one specifically designed ring or disk or ball or rod of regular or irregular shapes at a time, and from one specifically designed station to another specifically designed station at a time and stacked or placed, and the second game rule whether the specifically designed ring or disk or ball or rod of regular or irregular shapes being moved is smaller in size or shape or in serial number than the specifically designed ring or disk or ball or rod of regular or irregular shapes under it or on the left of it before the move and under it or on the left of it after the move, relevant to the type of the specifically designed stations whether stackable or place able from the top to the bottom or from the right to the left in ascending order, in the case any of the specifically designed two stations involved in this move has one or more specifically designed rings or disks or balls or rods of regular or irregular shapes under or on the left of the specifically designed ring or disk or ball or rod of regular or irregular shapes being moved, and if correct, the green lamp will switch on and the audio speaker produces the sound of correctness for a short designated period on the relevant specifically designed station, or if incorrect, the red lamp will switch on and the audio speaker produces the sound of incorrectness for a specific period of time on the relevant specifically designed station, and counting the move into the number of actual moves 'M' being made, whether the move is correct or incorrect, all information of the moves being transmitted to the specifically designed central control unit device from the relevant specifically designed stations; in the case of incorrect move, the specifically designed rings or disks or balls or rods of regular or irregular shapes involved in this move shall be put back at the relevant specifically designed station that it has last vacated before making any new move, and then the game continues.

(2) the second mode, designated Play Mode B, is for processing of the movements of the specifically designed rings or disks or balls or rods of regular or irregular shapes to determine each move follows exactly the step by step sequence as stated at the AmkRINGS Algorithm', if the move is correct and according to the AmkRINGS Algorithm, to switch the green lamp on and the audio speaker produce the sound of correctness for a short designate period on the relevant specifically designed station, or if the move is incorrect, to put the red lamp on and the audio speaker to produce the sound of incorrectness for a specific period of time on the relevant specifically designed station, and counting the move into the number of actual moves 'M' being made, whether the move is correct or incorrect, all information of the moves being transmitted to the specifically designed central control unit device from the relevant stations; in the case of incorrect move, the specifically designed rings or disks or balls or rods of regular or irregular shapes involved in this move shall be put back at the relevant specifically designed station that it has last vacated before making any new move, and then the game continues.

(3) the third mode, designated Play Mode C, is of the 'AmkRINGS Algorithm' game teaching mode which guides step by step the sequence of moves according to the 'AmkRINGS Algorithm', for training and practice purpose.

Another preferred embodiment provides a specifically designed central control unit device which has an electronic processing device capable of determining, when a game ended with the set of specifically designed rings or disks or balls or rods of regular or irregular shapes completely moved out from the specifically designed Original Station and completely stacked at a specifically designed Final Station, that the set of specifically designed rings or disks or balls or rods of regular or irregular shapes is stacked correctly in ascending order of size, shape or of serial numbers from top to bottom or from right to left depending on the type of the specifically designed stations, and only at the correct designated specifically designed Final Station and not at the specially designed Interim Station or even back at the specially designed Original Station, and if correct the central control unit device will end the game and send signal the Display Unit to display the status 'Game Ends', and if not correct the central control unit device will send signal to the Display Unit to display the status 'Game Fails'.

Another preferred embodiment provides a specifically designed central control unit device which has an electronic processing device capable of pausing the game for a certain short period without ending the game while keeping the game status unchanged, and of resuming the game from the paused game status, when the player applies the proper functional buttons from the menu function browsing knob and the menu function selection button.

Another preferred embodiment provides a specifically designed central control unit device which has an electronic processing device capable of stopping the game as an interval or as a session at any point or any time of the ongoing game and to be re-started at a later time; the specifically designed central control unit will save in its memory all the relevant data such as the game number, the player identities and info, date & time of the game, Play Mode, Player Mode, Game Mode, m, n, $m^y$, $n^y$, $M_i$, p, $p^y$, $P_i$, $Q_i$, L, d, $d^y$, $D_i$, $T_i$, but not limited to these; all interval or session stopped game data for every interval or session can be saved and will be retained in the memory for future reference until the player deletes these; when a player re-starts an interval or session stopped game, the specifically designed central control unit will recall from memory all the relevant data as saved at the last interval or session, will input for restarting the game and display these at the Display unit, check before the game re-starts that the items in play at the re-start are set up by the player or players according to the data input of the last interval or session, after receiving the transmitted information of the set up for the re-start from the three specifically designed stations, and then allow the game to re-start by display at the Display unit device.

Another preferred embodiment provides a specifically designed central control unit device which has an electronic processing device capable of completely ending the game before completion without saving any game status data if a player chooses to do so and applies the appropriate functional buttons.

Another preferred embodiment provides a central control unit device which has an electronic processing device capable of the menu functions for the player to select and an alphabet/numerals keyboard to key in the game number and player information, Play Mode, Player Mode, Game Mode, date & time of the game, n, L, input & data check, game start, pause, interval or session stop, restart, game end, set-up data check, data save, data recall, data delete, display on, but not limited to these, and transmitting these information to the display unit for display.

Another preferred embodiment provides a Display unit capable of receiving information or instruction transmitted from the specifically designed central control unit device, by wireless radio wave or wire cable, and displaying by electrical or electronic means, the game number and player(s) information, Play Mode, Player Mode, Game Mode, date & time of the game, input & data check m, n, M, $m^y$, $n^y$, $M_i$, p, P, Q, $p^y$, $P_i$, $Q_i$, L, d, $d^y$, D, $D_i$, T, $T_i$, game start, pause, interval or session stop, restart, game end, data saved, data recall, data delete, but not limited to these. The Display unit may have its own power source or may be connected to a power source by cable.

Another preferred embodiment provides for the specifically designed balls of the types basketball, net ball, hand ball (Olympic handball or Team handball), football (soccer), hockey ball, rugby ball, water polo ball, polo ball, but not limited to these, using in conjunction with the respective equipments and devices of the invention which are the specifically designed playgrounds (fields, pitches), the specifically designed goal posts, the three specifically designed stations, the specifically designed central control unit device and a display unit device, team competitions in which players in teams of two players or more than two players in Player Mode 'CT' can play, one team against another, following the said basic two game rules or the AmkRINGS Algorithm in Play Mode A or Play Mode B respectively, and following the established standard rules and regulation of each established sport, with some added or altered rules of the established as relevant for this specific game of the utilizing the said articles of the present invention, and such added or altered rules may be set by a relevant sport governing body for the specific sport.

Another preferred embodiment provides for the specifically designed balls of the types basketball, net ball, hand ball (Olympic handball or Team handball), football (soccer), hockey ball, rugby ball, water polo ball, polo ball, but not limited to these, utilizing the respective equipments and devices of the present invention which are the specifically designed playgrounds (fields, pitches), the specifically designed goal posts, the three specifically designed stations, the specifically designed central control unit device and a display unit device, two types of competition, namely Competition Modes 'UA' & 'BA', for playing in competition by teams in Player Mode 'CT', in which a team will comprise of two or more players and two teams will compete against each other in a game.

'UA' (Unilateral Attempt) competition is when one team in possession of the set of the specifically designed balls in play will attempt at goals or at scoring points using a determined set of the specifically designed balls while the other team will prevent or hinder the first team from scoring the goals or points, and after one side has completed the move of the whole set of the specifically designed balls in play from the Original to Final specifically designed station, the other side takes alternate possession of the set of the specifically designed balls. The competition can be score and/or time based. In general the team that completed the move of the whole set from the Original to Final specifically designed station in the shorter time will be the winner. For a fixed time period type of game, the team that completed the higher 'ny' within a fixed time period will be the winner. The number 'n' of the specifically designed balls in a set will determined the level of the game, the higher the number of said balls in a set, the more advance the game. For 'UA' type of competition, Play Mode 'A' and Play Mode 'B' can be played.

'BA' (Bilateral Attempt) competition is when both teams will try to possess the specifically designed ball in play and simultaneously attempt at goals as in a normal sport game, using a determined set of the specifically designed balls. For this type of 'BA' competition, only Play Mode 'B' can be played and is more complicated to play; a player or the side which get possession of a specifically designed ball in play must know correctly at which of the specifically designed three goal posts incorporated with the specifically designed stations to score, and the team that will get possession of the specifically designed ball at restart after a goal or point score, depending on the type of sport played, must then pick up the next specifically designed ball correctly from one of the three specifically designed station, to continue the game. For this 'BA' game, which team scores or be penalized for each correct move or incorrect move respectively of the specifically designed ball will be decided by the human umpire or umpires, in addition to the functions of the specifically designed central control unit device. The competition can be score and/or time based. On scores penalty points for incorrect moves may be incurred. Generally the team with the higher score—after minus the penalty points—is the winner, after the whole set of the specifically designed balls in play have been moved from the Original to Final specifically designed station. For 'BA' type of competition, there are no alternate possession of the set of the specifically designed balls in play after completion of the move of the whole set from the Original Station to the Final Station. The number of the specifically designed balls in a set will determined the level of the game, the higher the number 'n' of specifically designed balls in a set, the longer and more advance the game. Since both teams are attempting for goals or points at the same goal post at any time of the game, a player is required to have total skill, being a striker, a defender, a winger, at the same time for certain established sports.

Player Mode 'CS' can also play the 'UA' and 'BA' competitions with one player playing against another.

The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWINGS

Notwithstanding any other forms which may fall within the scope of the present invention, preferred embodiments of the invention will now be described, by way of example only, with reference to the accompanying drawings in which.

LIST OF REFERENCE NUMERALS UTILIZED IN THE DRAWINGS

Preferred Embodiment

Figure 1:
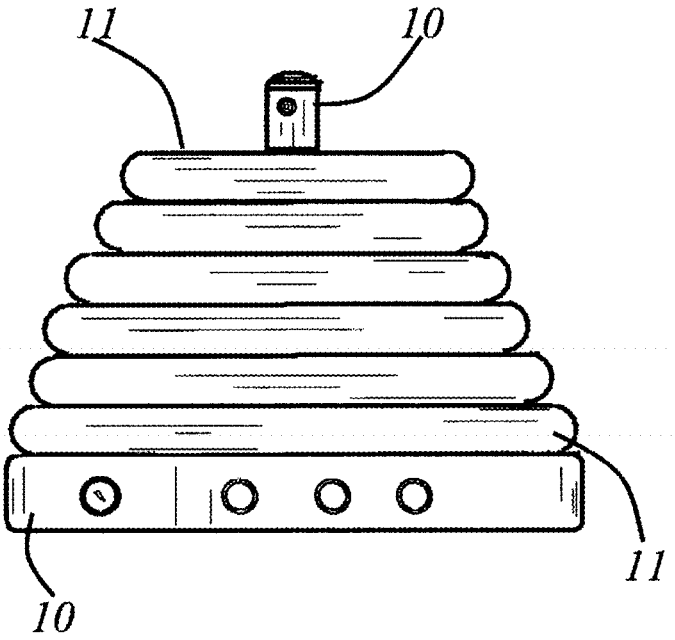
FIG. 1 is a diagrammatic front view of the preferred embodiment of the present invention with a set of specifically designed rings as stacked on one of the specifically designed stations of the vertical stacking type.
Figure 2:
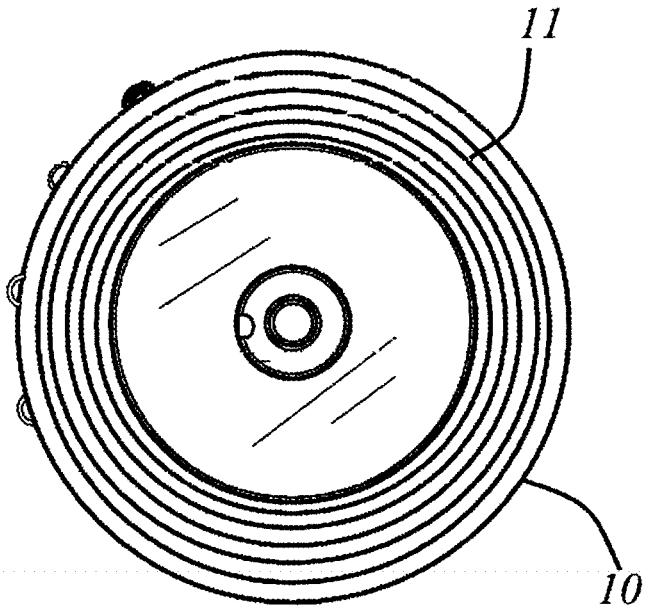
FIG. 2 is a diagrammatic top view of the preferred embodiment of the present invention with a set of specifically designed rings as stacked on one of the specifically designed stations of the vertical stacking type.

10 specifically designed station, vertical stacking type.
11 specifically designed ring or disk
12 lamp, green,
13 lamp, red,
14 lamp, blue,
15 transmitter/receiver-cum-ID tracking device,
16 audio speaker,
17 power on/off switch,
18 identification tag (ID)
20 specifically designed central control unit device
21 power lamp,
22 power on/off switch,
23 menu function knob,
24A play mode indicator lamp,
24B play mode indicator lamp,
24C play mode indicator lamp,
25 transmitter/receiver antenna,
26 cable wire for transmission and electrical power supply,
27 menu selection button
28 alphabets/numerals keyboard
30 display unit device
31 power on/off switch,
32 electronic device & receiving antenna,
33 display screen,
34 power lamp,
35 cable wire for transmission and electrical power supply,
41 player identification device,
42 arm band,
50 specifically designed playground with circular boundary
51 circular boundary of the specifically designed playground
52 one side of the imaginary equilateral triangle circumscribing the circular boundary
53 goal post, standard or specifically designed.
54 specifically designed goal post, circular type.
55 specifically designed goal post, rectangular type.
56 sensor
60 regular hexagon shape specifically designed playground
61 goal line

First Alternate and Second Alternate Embodiments

110 specifically designed station of the second alternate embodiment of the present invention, horizontal stacking type.
111 specifically designed ball of the first alternate embodiment of the present invention,
112 slot or space for placing the specifically designed ball or ring or disk.

Description of Embodiments

It should be noted in the following description that like or the same reference numerals in different embodiments denote the same or similar features.

Referring now to the Figures in which like numerals indicate like parts, and particularly to FIG. 1, in this preferred embodiment of the present invention of FIG. 1 is shown a set of the specifically designed rings or disks 11 as assembled in ascending order of shape or size or of serial number from the top to the bottom, on one of the three specifically designed stations 10, which is of the vertical stacking type where the specifically designed rings or disks 11 are stackable by sliding the specifically designed rings or disks onto the center rod of the specifically designed station from the bottom to the top in descending order of size, as shown.

The number of the specifically designed rings or disks 11 per set in play, designated 'n', can be from two rings or disks to any higher number, typically from six rings or disks to twelve, but not limited to this. The specifically designed rings or disks 11 are of similar shape or feature, of regular or irregular shapes, of different sizes and weights as shown but can be of the same size and the same weight, and are stackable from the bottom to the top in descending order of diameters for rings or disk forms or of sizes for other shapes or of serial numbers, (thus, the specifically designed rings or disks 11 are stacked in ascending order from the top to the bottom). The specifically designed rings/disks 11 are stackable on the specifically designed station 10 in full set or any partial numbers of the set.

Any one of the specifically designed rings/disks 11 is of the weight and the size of throw-able and catch-able, passable or movable, by a single hand or by both hands, or by feet, by any of the three players, each player stationed at each one of the three specifically designed stations 10 which are placed at reasonable distances of 'L', catering for different ages or build of the players. Typical weight of a specifically designed ring/disk 11 can range from 100 gram to 300 gram, but not limited to this. The typical throwing distance 'L' can be from five meters to fifteen meters, but not limited to this. The specifically designed rings/disks 11 are also carry-able, one at a time by a single person, from one to another of the three specifically designed stations 10 placed at three separate locations at preferred distances of 'L' from one another.

The specifically designed rings/disks 11 and the three specifically designed stations 10 can be made of various materials such as wood, leather, rubber, plastics, composites, light metals, but not limited to these, which are suitable for throwing and catching, moving and passing, and carry-able for the said specifically designed rings/disks 11, and suitable for stacking of the said specifically designed rings/disks 11 for the said specifically designed stations 10. To make it easy for visual identification, the specifically designed rings/disks 11 have distinctly marked serial numbers, of various different colors or different tones of a color or colors differentiating their sizes or their serial numbers in ascending order in relation to their positions in a set in play.

Figure 4:
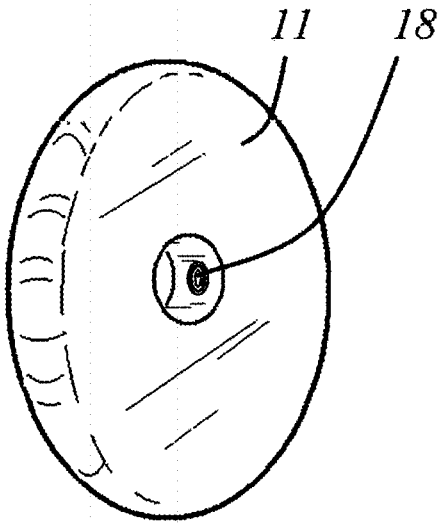
FIG. 4 is a diagrammatic perspective view of the preferred embodiment of the present invention showing a specifically designed ring with equal diameter center hole.

Each of the specifically designed rings/disks 11, in FIG. 4, has an implanted identification tag (ID) 18 such as a bar code, a magnetic strip, a radio frequency (RF) tag, but not limited to these, and can identify itself relevant to its position in a set in play based on its size or shape or serial number to a transmitter/receiver cum ID tracking device 15 and implanted at any of the three specifically designed stations 10 where the said ring/disk 11 is stacked, and when the said ring/disk 11 is vacating, to the transmitter/receiver cum ID tracking device 15 implanted at the said specifically designed station 10 that the said ring/disk 11 is vacating, and to the transmitter/receiver cum ID tracking device 15 implanted at the other one of the three specifically designed stations 10 that is receiving the said ring/disk 11 to be stacked, during the process of a move in play.

Figure 3:
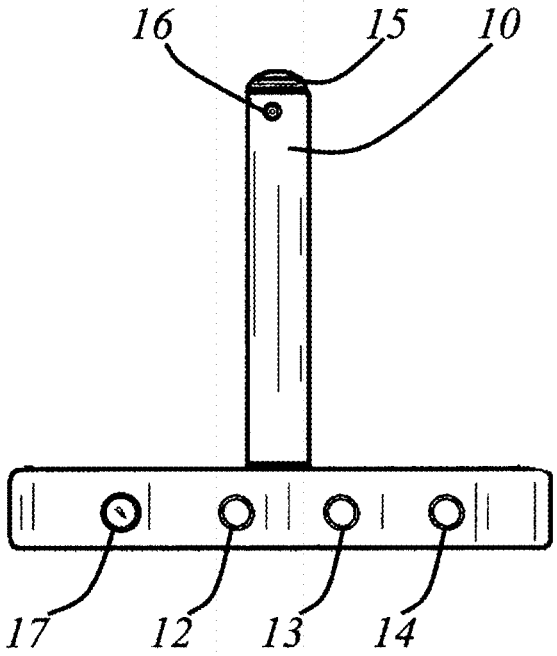
FIG. 3 is a diagrammatic front view of the preferred embodiment of one the three specifically designed stations of the vertical stacking type, with straight diameter center rod.
Figure 5:
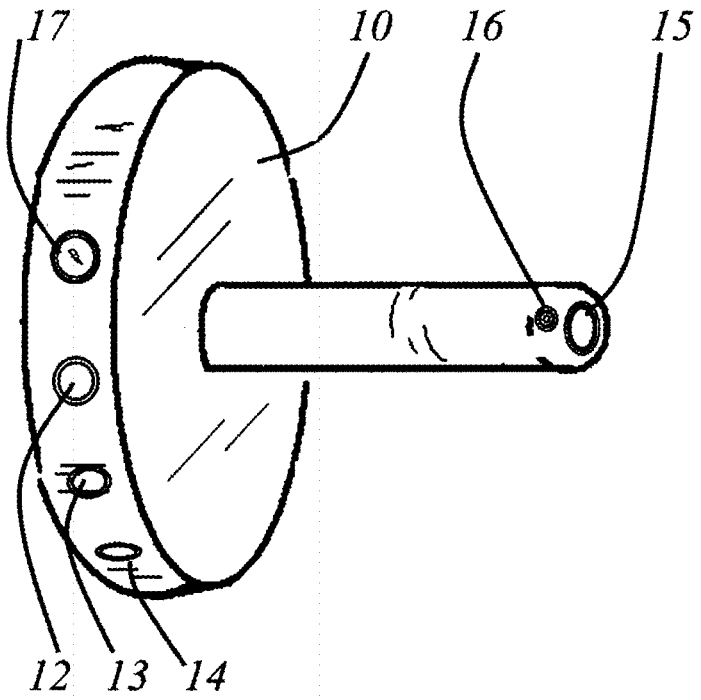
FIG. 5 is a diagrammatic perspective view of the preferred embodiment of the present invention showing a specifically designed station of the vertical stacking type, with straight diameter center rod.

In FIG. 3 and FIG. 5 are shown one of the three specifically designed stations 10 of the type where the specifically designed rings/disks 11 can be stacked from the top to the bottom in ascending order (from the bottom to the top in descending order) of the diameters or sizes or of serial numbers, in full set or in any partial numbers of set. The three specifically designed stations 10 are of the same design feature, shape and size within a set but have individual identifications by basic color: the first one is the Original station 10 with blue color, the second one is the Interim Station 10 with yellow color, and the third one is the Final Station 10 with green color.

The specifically designed station 10 in FIG. 3 and FIG. 5 is equipped with a transmitter/receiver-cum-ID tracking device 15, that can identify itself, and can identify the specifically designed ring/disk 11 that is vacating it or that is coming in to stack on it, during the process of a move in play, by tracking or reading the identification tag (ID) 18 of the specifically designed ring/disk 11, and is able to transmit these information to, and able to receive transmitted information and instruction from, a specifically designed Central Control Unit device 20, by means of wireless radio frequency or by cable wire.

The specifically designed station 10 has three lamps of colors green 12, red 13 and blue 14, which will light up as per instruction received from the specifically designed central control unit device 20, by means of wireless radio frequency or by cable wire. The specifically designed station 10 has an audio speaker 16 which will produce sound as per instruction received from the specifically designed central control unit device 20, by means of wireless radio frequency or by cable wire.

The specifically designed station 10 has a power on-off switch 17 and is equipped with its power source and can also be connected by wire cable to an external power source for electrical power.

Figure 6:
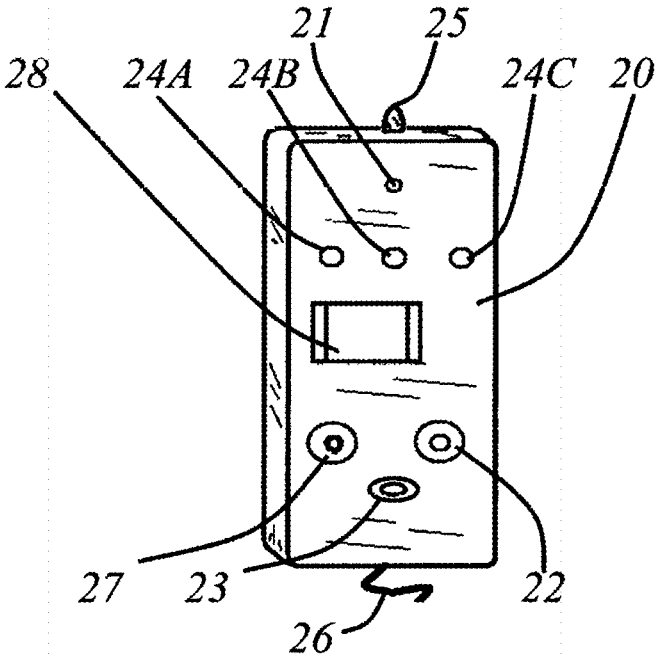
FIG. 6 is a diagrammatic perspective view of the preferred embodiment of the present invention of the specifically designed central control unit device.

In FIG. 6 is shown the specifically designed central control unit device 20 which is an electronic processor capable to receive the information transmitted from any of the three specifically designed stations 10, to process and manage the information received and to transmit instructions to any of the three specifically designed stations 10 or to transmit instructions to the Display unit 30, by wireless radio frequency through its transmitter/receiver antenna 25 or by the wire cable 26.

The specifically designed central control unit device 20 has the capability to process the information transmitted from any of the three specifically designed stations 10 and to check the set up at the start of a new game that a set of specifically designed rings or disks 11 are properly stacked in full set of ascending order of size or shape or in serial number from the top to the bottom at the Original Station of the specifically designed station 10 in this preferred embodiment of the present invention, that the other two specifically designed stations 10, namely the Interim Station and the Final Station of the specifically designed station 10 in this preferred embodiment of the present invention, do not have any specifically designed ring or disk 11 stacked on them, and determining the number, which is designated as 'n', of specifically designed rings or disks 11 in the full set to be played, and which is stacked on the said Original Station of the specifically designed station 10, and when confirmed that the set up is properly done, to transmit this information to the display unit 30 to display 'n', and to indicate that the set up is complete and correct and the game can start, to display 'Start'.

The specifically designed central control unit device 20 has the capability to process the information transmitted from any of the three specifically designed stations 10 on the movement of the specifically designed rings or disks 11 from one specifically designed station 10 to another, and to determine, in the process of a move in play, whether the specifically designed ring or disk 11 being moved follows the game rule of moving one specifically designed ring or disk 11 at a time, and from one specifically designed station 10 to another specifically designed station 10 at a time and stacked or placed; this is according to the first game rule.

The specifically designed central control unit device 20 has the capability to process the information transmitted from any of the three specifically designed stations 10 on the movement of the specifically designed rings or disks 11 from one specifically designed station 10 to another, and to determine, in the process of a move in play, whether the specifically designed ring or disk 11 being moved follows the game rule of it being smaller in size or shape or in serial number than the specifically designed ring or disk 11 under it before the said move and under it after the said move where the said specifically designed rings or disks 11 are stacked in ascending order from the top to the bottom, relevant to the two involved specifically designed stations 10, which are designate the Vacating Station and the Receiving Station respectively for this said move, in the case any of the said two specifically designed stations 10 involved in said move already has one or more specifically designed rings or disks 11 under the said specifically designed ring or disk 11 being moved; this is according to the second game rule.

The specifically designed central control unit device 20 has the capability to calculate the mathematical formula used for the game rule:

$$[m=2^n-1], \qquad \text{Equation 1}$$

where

'n' is the number of the specifically designed rings/disks 11 in the set played in a game;

'm' is the minimum number of moves possible to move the whole set of 'n' number of the specifically designed rings/disks 11 from the Original Station to the Final Station of the specifically designed stations 10, utilizing the specifically designed Interim Station 10 during the moves, when the game is played according to the said two game rules.

The specifically designed central control unit device 20 has the capability to transmit this information to the display unit 30 and instruct to display the numbers in numerals beside the displayed letters 'm' and 'n', by wireless radio waves through the transmitter/receiver antenna 25 or by the wire cable 26.

Yet still another objective of the present invention is to provide a specifically designed central control unit device 20 which has the electronic processing device capable of processing the transmitted information from the relevant specifically designed stations 10 of the moves of the specifically designed rings or disks or balls or rods of regular or irregular shapes 11, and calculating with reference to the formula 'm=($2^n$−1)' or the 'AmkRINGS Algorithm' of Table 1, the interim minimum move '$m^v$' possible for the interim number of the specifically designed rings or disks or balls or rods of regular or irregular shapes 11 '$n^v$' already moved for the first time from the Original specifically designed station 10 at that stage, at any stage of the move before the game reaches completion. This '$m^v$' will be equal to 'm' and '$n^v$' to 'n' at the completion of the game.

The specifically designed central control unit device 20 has the capability of computing the actual number of moves designated 'M' being made by the specifically designed rings or disks 11 as the specifically designed rings or disks or balls 11 are being moved from one specifically designed station 10 to another during the moves in play; any move of play of one specifically designed ring or disk 11 from one specifically designed station 10 to another specifically designed station 10, whether correct or incorrect, is counted as one move, and with the specifically designed stations 10 transmitting the information of each of these moves to the specifically designed central control unit device 20, and the specifically designed central control unit device 20 being capable to transmit to the electronic display unit 30 for displaying the actual number of moves 'M', by means of wireless radio waves through its transmitter/receiver antenna 25 or by the wire cable 26.

The specifically designed central control unit device 20 has the capability of computing the 'AmkRINGS Algorithm', as per Table 1, of the necessary step by step sequence of the movement of the specifically designed rings or disks or balls or rods of regular or irregular shapes 11 to any of the three specifically designed stations 10 to achieve the minimum number of moves 'm' possible for a given number 'n' of specifically designed rings or disks of regular or irregular shapes 11 in a set being moved from the Original specifically designed station 10 to the Final specifically designed station 10, making use of the Interim specifically designed station 10 and when played according to the said two game rules, and this processing capability feature can be turned on or off as per choice. The step by step sequence process in the said table can continue up to any higher number 'x' of the specifically designed rings or disks of regular or irregular shapes 11.

If the number 'n' of the specifically designed rings or disks or balls of regular or irregular shapes 11 in the set in play is an even number, the columns for the Interim Station and the Final Station in upper block is to be applicable, whereupon the very first specifically designed ring or disk of regular or irregular shapes 11 in the set in play is moved to the Interim Station 10 first at the start of the game.

If the number 'n' of the specifically designed rings or disks of regular or irregular shapes 11 in the set in play is an odd number, the columns for the Interim Station and the Final Station in lower block is to be applicable, whereupon the very first specifically designed ring or disk of regular or irregular shapes 11 in the set in play is moved to the Final Station 10 first at the start of the game.

The specifically designed central control unit device 20 has the capability of processing the transmitted information of the move from the relevant specifically designed stations 10, whether the step by step sequence of the specifically designed ring or disk or ball of regular or irregular shapes 11 being moved is in accordance with the step by step sequence stated in the 'AmkRINGS Algorithm' of Table 1, and capable of transmitting to any of the two relevant specifically designed stations 10 involved in the move, if the move is correct, to switch on the green light 12 and the audio sound 16 of correctness for a short designated period, or if the move is incorrect, to switch on the red light 13 and the audio sound 16 alarm of incorrectness for a short designated period of time, by means of wireless radio waves or by the wire cable.

The specifically designed central control unit device 20 has the capability to process the transmitted information from the relevant specifically designed stations 10 of the moves of the specifically designed rings or disks 11, and to calculate with reference to the formula 'm=($2^n$−1)' or the 'AmkRINGS Algorithm' of Table 1, the possible minimum number of moves 'p' a solo player playing in the Player Mode 'S', can make between the specially designed stations 10 for any number of 'n' of the specifically designed rings or disks 11 in play, when the specifically designed stations 10 are positioned at distances of 'L' between them, for games designated Game Mode 'PP', that requires a solo player to carry and move with the specifically designed ring or disk or ball or rod 11, and the solo player moving between the specifically designed stations 10 by walking, jogging, riding, skating, swimming, etc., as examples using specifically designed water polo balls or specifically designed basketballs 11; the formula is:

$$'p=2m-1'; \qquad \text{Equation 2}$$

the extra moves of 'p' of the solo player compared to moves 'm' of the specifically designed rings or disks or ball or rod 11 is due to the solo player has to make an empty handed additional move to a specifically designed station 10 to pick up the next specifically designed ring or disk or ball or rod 11 to be moved.

Figure 9:
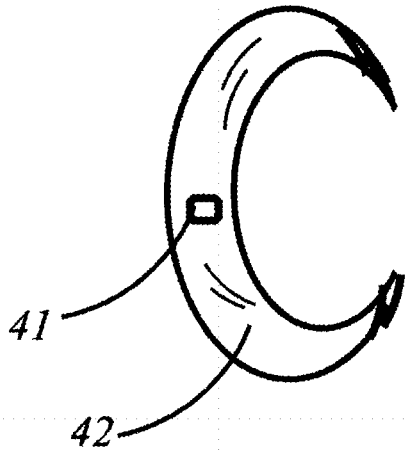
FIG. 9 is a diagrammatic perspective view of the preferred embodiment of the present invention showing a player identification device with an armband.

The specifically designed central control unit device 20 has the capability to process the movements of a player identification device 41 as shown in FIG. 9, which is tracked by the specifically designed stations 10 when a player equipped with the said player identification device 41 personally makes a move during the play or exercise between two specifically designed stations 10 which are placed at a pre-determined distance 'L'; any actual move in play, designated 'P', of the solo player between one of the specifically designed station 10 to another specifically designed station 10, whether it is a correct move or an incorrect move of the specifically designed ring or disk 11 carried by the player, is counted as one move for the player, and this information of the move of the player is transmitted to the specifically designed central control unit 20 by the specifically designed stations 10 involved in the moves. The player identification device 41 can be set on or off as necessary and attachable to a player as a clipped on or with arm band 42, etc.

The specifically designed central control unit device 20 has the capability to process the transmitted information from the relevant specifically designed stations 10, of the moves of the specifically designed rings or disks or balls or rods 11 of regular or irregular shapes, and of the moves of the solo player tracked from the player identification device 41, and counting the actual number of moves 'P' a solo player playing in the Player Mode 'S', makes between the specially designed stations 10 for any number of 'n' of the specifically designed rings or disks or balls or rods 11 of regular or irregular shapes in play, when the specifically designed stations 10 are positioned at distances of 'L' between them, for those games designated Game Mode 'PP', that require a solo player to carry and move with the specifically designed ring or disk or ball or rod 11 in play, and the solo player moving between the specifically designed stations 10 by walking, jogging, riding, skating, swimming, etc., as examples using specifically designed water polo balls 11 or specifically designed basketballs 11.

The extra actual moves of 'P' of the solo player compared to the actual moves 'M' of the specifically designed rings or disks or ball or rod 11 is due to the solo player has to make an empty handed additional move to a specifically designed station 10 to pick up the next specifically designed ring or disk or ball or rod 11 to be moved.

The specifically designed central control unit device 20 has the capability to process the transmitted information from the relevant specifically designed stations 10, of the moves of the specifically designed rings or disks or balls or rods 11 of regular or irregular shapes, and of the moves of the solo player tracked from the player identification device 41, and counting the actual number of moves 'Q' a solo player playing in the Player Mode 'S', makes between the specially designed stations 10 for any number of 'n' of the specifically designed rings or disks or balls or rods 11 of regular or irregular shapes in play, when the specifically designed stations 10 are positioned at distances of 'L' between them, for those games designated Game Mode 'QQ', that require a player to use a delivery means to move the specifically designed ring or disk or ball or rod 11 of regular or irregular shapes between the specifically designed stations 10, for examples by using a golf club for moving a specially designed golf ball 11, or by using an archery bow for moving a specifically designed arrow 11, etc., and then the solo player moving between the specifically designed stations 10 by walking, jogging, riding, etc. The extra actual moves of 'Q' of the solo player compared to actual moves 'M' of the specifically designed rings or disks or ball or rod 11 is due to the solo player has to make an additional necessary move to a specifically designed station 10 to pick up, send or deliver the next specifically designed ring or disk or ball or rod 11.

The specifically designed central control unit device 20 has the capability to process the transmitted information from the relevant specifically designed stations 10 placed at distances 'L' from one another, of the moves 'm' and 'M' of the specifically designed rings or disks or balls or rods 11, and of the moves 'p' and 'P' of the solo player playing in the Player Mode 'S', calculated from 'm' for 'p' and tracked from the player identification device 41 for 'P', and calculating the minimum possible distance 'd' and the actual distance 'D' covered by the solo player, by multiplying 'L' with 'p' and 'P', respectively, for the type of games designated Game Mode 'PP', that require a solo player to carry and move with the specifically designed ring or disk or ball or rod 11, by walking, jogging, riding, skating, swimming, etc., and calculating the time 'T' elapsed for the game, but not limited to these. For interval or session stopped game, the minimum possible '$m^y$', '$p^y$', the actual moves '$M_i$', '$P_i$', the distance '$d^y$', '$D_i$' and the time elapsed '$T_i$', relating to the '$n^y$' numbers of specifically designed ring or disk 11 already moved out for the first time from the specifically designed Original station 10 at the interval or session stop, are calculated.

The specifically designed central control unit device 20 has the capability to process the transmitted information from the relevant specifically designed stations 10 placed at distances 'L' from one another, of the moves 'm' and 'M' of the specifically designed rings or disks or balls or rods 11, and of the moves 'Q' of the solo player playing in the Player Mode 'S', tracked from the player identification device 41, and calculating the actual distance 'D' covered by the solo player, by multiplying 'L' with 'Q' for those games designated Game Mode 'QQ', that require a solo player to use a delivery means to move the specifically designed ring or disk 11 between the specifically designed stations 10, for examples by using a golf club for moving a specially designed golf ball or by using an archery bow for moving a specifically designed arrow, etc., and then the solo player moving between the specifically designed stations 10 by walking, jogging, riding, and calculating the time 'T' elapsed for the game, but not limited to these. For interval or session stopped game, the minimum possible '$m^y$', the actual moves '$M_i$', '$Q_i$', the distance '$D_i$' and the time elapsed '$T_i$' relating to '$n^y$' numbers of the specifically designed ring or disk 11 already moved out for the first time from the specifically designed Original station 10 at the interval or session stop, are calculated.

The specifically designed central control unit device 20 is portable, has its own power source or can be connected with external power supply (not shown), has the power on-off light 21, the power on-off switch 22, menu functions browsing knob 23, three play mode indicator lamps 24A, 24B, 24C, the transmitter/receiver antenna 25 for radio frequency type of transmission, four cable wires 26 for cable wire type transmission of information and for power source supply to the three specifically designed stations 10 and to the display unit 30, menu functions selection button 27, and alphabets/numerals keyboard 28 such as a qwerty keyboard to key in data relevant to the game such as player names, etc.

Figure 7:
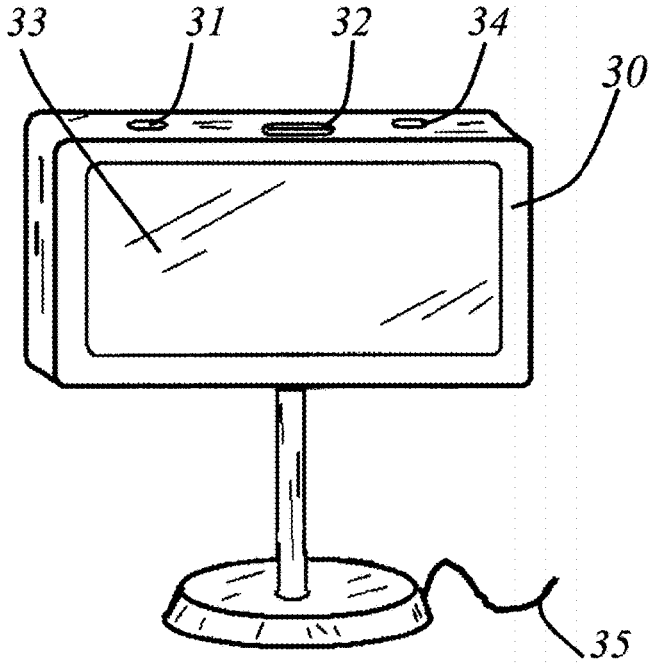
FIG. 7 is a diagrammatic perspective view of the preferred embodiment of the present invention of the display unit device.
Figure 8:
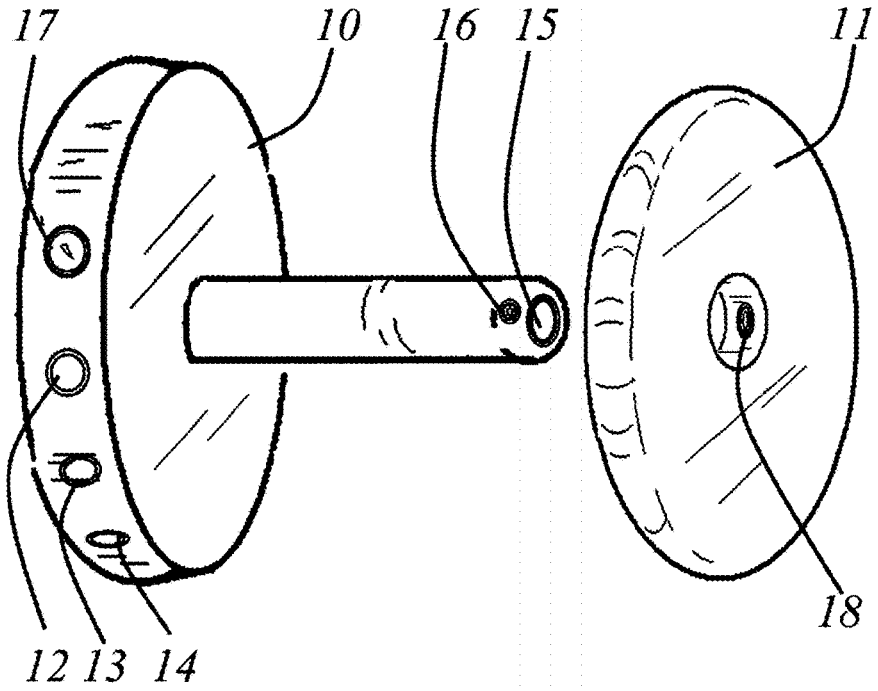
FIG. 8 is a diagrammatic perspective view of the preferred embodiment of the present invention showing a specifically designed ring and a specifically designed station of the vertical stacking type.

FIG. 7 shows the Display unit 30 which is capable of receiving information or instruction transmitted from the specifically designed central control unit device 20 by wireless radio wave or wire cable, which has a display screen 33, electronic or otherwise, to display information such as game number, player names, Play Mode, Player Mode, Game Mode, Competition Mode, date & time of the game, input & data check, m, n, M, $m^y$, $n^y$, $M_i$, p, P, Q, $p^y$, $P_i$, $Q_i$, L, d, $d^y$, D, $D_i$, T, $T_i$, game start, pause, interval or session stop, restart, game end, data saved, data recall, data delete, etc as per instruction received from the specifically designed central control unit 20, by menu functions or key in data, but not limited to these. The display unit 30 is portable, has power on-off switch 31, equipped with electronic device with antenna 32 to receive the wireless radio frequency transmission from the specifically designed central control unit 20. It has its own power source, with power lamp 34 or it can be connected to the specifically designed central control unit 20 by wire cable 35 for power source and for electronic transmission.

At the start of the new physical game, all the components to be used in the game will have the power switch on or wire cables connected as necessary; then a set of specifically designed rings/disks 11, taking six units for the set as the preferred embodiment of the present invention, are stacked in ascending order of size, shape or serial number from the top to the bottom, on the specifically designed station 10 of the vertical stacking type with blue color, which is the Original Station, from where the whole set of the stacked specifically designed rings/disk 11 will be moved out completely, following the said two game rules, finally to another specifically designed station 10 with green color, which is the Final Station, involving also during the moves, the remaining specifically designed station 10 with yellow color, which is the Interim Station. The specifically designed central control unit device 20 will process from the transmitted information received from the three specifically designed stations 10, that the set of the specifically designed rings/disks 11 are properly stacked in ascending order of size or shape or serial number from the top to the bottom at the Original Station of the specifically designed station 10, and that the other two specifically designed stations 10 namely the Interim Station and the Final Station, do not have any specifically designed rings/disks 11 on it, and count the number of specifically designed rings/disks 11 'n' in the set, in this case 'n'=6. The central control unit device 20 will calculate the minimum moves possible 'm' for the said 'n' using the formula [$m=2^n-1$], in this case 'm'=63, and will continue to process for '$m^y$' and '$n^y$' as the game proceeds.

The moves, following the first game rule of moving one specifically designed ring/disk 11 at a time, from one specifically designed station 10 to another specifically designed station 10 at a time, can be made by three players each manning at one of the three specifically designed stations 10 placed at distances 'L' from one another, by taking out, throwing or passing, catching and stacking the specifically designed rings/disks 11 in play which is designated Player Mode 'T' or can be made by anyone of the three players, one player at a time, manually taking out and carrying the specifically designed rings/disks 11 in play, one specifically designed ring/disk 11 at a time, moving by walking, jogging, skating, swimming, etc., from one to any other one of the three specifically designed stations 10 placed at distances 'L' from one another, and stacking, and this Player Mode is designated Player Mode 'TR' and this Game Mode of relay type is designated Game Mode 'RR'; also, the moves can be made by a solo player, manually taking out and carrying the specifically designed rings/disks 11 in play, one specifically designed ring/disk 11 at a time, moving by walking, jogging, skating, swimming, etc., from one to any other one of the three specifically designed stations 10 one at a time, and placed at distances 'L' from one another, and stacking, and this Player Mode is designated Player Mode 'S'. When more than one team of three players are participating in the game manning the specially designed stations 10, or moving among the three specifically designed stations 10, with the teams replaceable or exchangeable, the Player Mode is designated Player Mode 'GT and 'GTR, respectively. When more than one player is participating in the game with a solo player moving between the three specially designed stations 10, and the solo player is exchangeable or replaceable from the group, the Player Mode is designated Player Mode 'GS'.

The moves of the specifically designed ring/disk 11 being vacated from one specifically designed station 10 which is designated the Vacating Station for this move, and it being the top specifically designed ring/disk 11 if there are more than one specifically designed ring/disk 11 at that Vacating Station of the specifically designed station 10, and being moved to another specifically designed station 10, designated the Receiving Station for this move, follows the second game rule that the said specifically designed ring/disk 11 being moved must be smaller in size or shape or of lower serial number than the size or shape or the serial number of the top specifically designed ring/disk 11 already at the said Receiving Station of the specifically designed station 10, if the said Receiving Station of the specifically designed station 10 already has one or more specifically designed ring/disk 11 stacked on it.

To start with the Play Mode A, for which the specifically designed control unit device 20 is programmed to monitor that any move must follow the said two game rules, the player uses the menu functions browsing knob 23 and menu functions selector button 27 on the specifically designed central control unit device 20, selects the Play Mode A and the play mode indicator lamp 24A will light up; the player(s) will select the Player Mode whether the game will be played by a solo player with Player Mode 'S' or by three players with Player Mode 'T', 'TR', or by a group of players with 'GS', 'CS' or 'GT', 'GTR', 'CT' for this Play Mode A; and this selection feature is applicable also for the Play Mode B to be described later.

For the present preferred embodiment of the game, either the solo Player Mode 'S', GS' or the three Players Mode 'T', 'TR', 'GT', 'GTR' are applicable; the Game Mode 'PP' or 'QQ' can be further chosen with the solo Player Mode 'S', 'GS', and the Game Mode 'RR' for the three players Player Modes 'TR', 'GTR', relevant to the type of sports game to be played; the player will use the alphabet/numeral keyboard 28 and key in the set distance 'L' between the three specifically designed stations 10, other information or data such as players, date, time, but not limited to these. The display unit 30 will display this information on the screen 33 as transmitted from the specifically designed central control unit 20.

The identification tag (ID) 18 of the specifically designed ring/disk 11, when the said specifically designed ring/disk 11 is being vacated and moved from any one of the specifically designed station 10 that is the current Vacating Station for the current move, and when being received and stacked at any one of the other two specifically designed station 10 that is the current Receiving Station for the current move, will inform its identity to, or is being tracked by, the transmitter/receiver-cum-ID tracking device 15 of both the said Vacating and the said Receiving Stations, which are the specifically designed stations 10.

Both the said Vacating and the said Receiving specifically designed stations 10 will then transmit through its transmitter/receiver-cum-ID tracking device 15, this information of the identity and the related move of the said specifically designed ring/disk 11, to the specifically designed central control unit device 20.

The said specifically designed central control unit device 20 will process, as programmed, the information received from the said specifically designed stations 10, namely the Vacation station and the Receiving station, received through the transmitter/receiver antenna 25, and process and manage from the received information, whether the moves are made or not according to Play Mode A and other relevant game data If the correct move has been made according to said two game rules defined by Play Mode A the said specifically designed central control unit device 20 will transmit instruction to the said Receiving specifically designed station 10 to light up the green lamp 12 for a short period and to the audio speaker 16 to make a short audio sound of correctness. The said central control unit device 20 will count this move and add to the actual number of moves 'M' for the specifically designed rings or disks 11 and instruct the display unit to display this actual number of move at 'M'.

For a three player game set at Player Mode 'T', the specifically designed central control unit device 20, will calculate the minimum moves '$m^y$' possible for the specifically designed rings or disks 11 at that stage of the move relating to '$n^y$' already moved out for the first time from the Original specifically designed station 10 at that stage; for a solo player game set at Player Mode 'S', the specifically designed central control unit device 20 will calculate '$m^y$' relating to '$n^y$', the possible minimum number of moves 'p' a player can make between the specially designed stations 10 for any number of 'n', the possible minimum number of moves '$p^y$' a player can make between the specially designed stations 10 for any interim number of '$n^y$', and count the actual number of moves 'P' or 'Q' a player makes between the specially designed stations 10 for any number of 'n' depending on which Game Mode PP or QQ being played, when the specifically designed stations 10 are positioned at distances 'L' of between them, and calculate the minimum possible distance 'd' and the actual distance 'D' covered by the player, by multiplying 'L' with 'p' and 'P' or 'Q' respectively, and the time 'T' taken to make the moves for either the three players or the solo player game, and transmit this information to the display unit 30 by wireless radio frequency through the transmitter/receiver antenna 25 or by the wire cable 26. The display unit 30 will receive this information through the electronic device and antenna 32 or the wire cable 26 and display the number in numerals beside the displayed letter 'n', 'm', '$m^y$', '$n^y$', 'M', 'p', '$p^y$', 'P' or 'Q', 'd', '$d^y$', 'D', 'T' on the display screen 33, but not limited to these.

If the move of the specifically designed ring/disk 11 has not been made according to the said two game rules defined by Play Mode A, the said specifically designed central control unit device 20 will transmit instruction to the said Receiving specifically designed station 10 to light up the red lamp 13 for a short period and to the audio speaker 16 to make a short audio sound of error. The said specifically designed ring/disk 11 involved in the erroneous move will then be taken out from the said Receiving specifically designed station 10 and moved back to the said vacating specifically designed station 10 that it has last vacated before continuing with any new move again, both of the said specifically designed stations 10 will transmit this information to the specifically designed central control unit device 20 to be processed. This information will be processed and the incorrect move of the specifically designed ring/disk 11 will still be counted as one actual move on the whole although the said move was incorrect, and add on to the actual number of move 'M' and displayed, the extra moves 'P' or 'Q' made, if any, to move back the said specifically designed ring/disk 11 involved in the erroneous move will also be counted, hence all data related to actual moves such as 'P', 'Q', 'D', 'T', will correspond with the current updated 'M'; other than that the play status will be as before this last move from the Vacating specifically designed station 10, $m^y$, $n^y$, $p^y$, $d^y$, remain unchanged from the status before this last move of the specifically designed ring or ball 11 and the player's last move for the solo player from the Vacating specifically designed station 10, and the said specifically designed central control unit will instruct the display unit 30 to display the updated number of 'M', 'P', 'Q', 'D', 'T', and to resume the game.

To play with the Play Mode B, which must follow the step by step sequence of AmkRINGS Algorithm, the player uses the menu functions browsing knob 23 and menu functions selector button 27 on the specifically designed central control unit device 20, selects the Play Mode B and the play mode indicator lamp 24B, will light up.

The specifically designed central control unit device 20 will, as programmed, process the AmkRINGS Algorithm per Table 1, which is shown below, of the step by step sequence of moves to achieve the minimum number of moves 'm' possible for any number 'n' of specifically designed rings/disks 11, according to the two game rules and according to the mathematical formula [$m=2^n-1$] of equation 1.

The step by step sequence process in the said Table 1 shows up to 12 specifically designed rings or disks 11 for 'n' and the step by step sequence can continue up to any higher number 'x' for 'n' of the specifically designed rings or disks 11.

For information, if 'x' equals 64, that is there are 64 specifically designed rings/disk 11 to move in a game, and if the player(s) can make every step of the move correctly, it will take over eighteen million trillion (1.8×1019) minimum moves for 'm', and if the player(s) will take one second only to make a move, the game will last for over five hundred and sixty billion (560×109) years.

If the number 'n' of the specifically designed rings or disks 11 in the set in play is an even number, the columns for the Interim Station and the Final Station of the specifically designed stations 10 in upper block is to be applicable, wherein the very first specifically designed ring or disk 11 in the set in play is moved to the Interim Station of the specifically designed stations 10 first at the start of the game.

If the number 'n' of the specifically designed rings or disks 11 in the set in play is an odd number, the columns for the Interim Station and the Final Station of the specifically designed stations 10 in lower block is to be applicable, wherein the very first specifically designed ring or disk 11 in the set in play is moved to the Final Station of the specifically designed stations 10 first at the start of the game.

The specifically designed central control unit device 20 will process, as programmed, from the transmitted information received from the three specifically designed stations 10 tracking the moves of the specifically designed rings/disks 11, whether the said moves are made or not according to the step by step sequence of the said AmkRINGS Algorithm, per Table 1 below, that is the Play Mode B.

TABLE 1

AmkRINGS Algorithm
Step by Step Method of Moves

| NO. OF LAYER n | MOVE NO. m | ORIGINAL STATION | INTERIM STATION (EVEN NO. OF n) FINAL STATION (ODD NO. OF n) | FINAL STATION (EVEN NO. OF n) INTERIM STATION (ODD NO. OF n) |
|---|---|---|---|---|
| 3 | 0 | 1~x | — | — |
| | 1 | 2~x | 1 | — |
| | 2 | 3~x | 1 | 2 |
| | 3 | 3~x | — | 1, 2 |
| | 4 | 4~x | 3 | 1, 2 |
| | 5 | 1, 4~x | 3 | 2 |
| | 6 | 1, 4~x | 2, 3 | — |
| | 7 | 4~x | 1, 2, 3 | — |
| 4 | 8 | 5~x | 1, 2, 3 | 4 |
| | 9 | 5~x | 2, 3 | 1, 4 |
| | 10 | 2, 5~x | 3 | 1, 4 |
| | 11 | 1, 2, 5~x | 3 | 4 |
| | 12 | 1, 2, 5~x | — | 3, 4 |
| | 13 | 2, 5~x | 1 | 3, 4 |
| | 14 | 5~x | 1 | 2, 3, 4 |
| | 15 | 5~x | — | 1, 2, 3, 4 |
| 5 | 16 | 6~x | 5 | 1, 2, 3, 4 |
| | 17 | 1, 6~x | 5 | 2, 3, 4 |
| | 18 | 1, 6~x | 2, 5 | 3, 4 |
| | 19 | 6~x | 1, 2, 5 | 3, 4 |
| | 20 | 3, 6~x | 1, 2, 5 | 4 |
| | 21 | 3, 6~x | 2, 5 | 1, 4 |
| | 22 | 2, 3, 6~x | 5 | 1, 4 |
| | 23 | 1, 2, 3, 6~x | 5 | 4 |
| | 24 | 1, 2, 3, 6~x | 4, 5 | — |
| | 25 | 2, 3, 6~x | 1, 4, 5 | — |
| | 26 | 3, 6~x | 1, 4, 5 | 2 |
| | 27 | 3, 6~x | 4, 5 | 1, 2 |
| | 28 | 6~x | 3, 4, 5 | 1, 2 |
| | 29 | 1, 6~x | 3, 4, 5 | 2 |
| | 30 | 1, 6~x | 2, 3, 4, 5 | — |
| | 31 | 6~x | 1, 2, 3, 4, 5 | — |
| 6 | 32 | 7~x | 1, 2, 3, 4, 5 | 6 |
| | 33 | 7~x | 2, 3, 4, 5 | 1, 6 |
| | 34 | 2, 7~x | 3, 4, 5 | 1, 6 |
| | 35 | 1, 2, 7~x | 3, 4, 5 | 6 |
| | 36 | 1, 2, 7~x | 4, 5 | 3, 6 |
| | 37 | 2, 7~x | 1, 4, 5 | 3, 6 |
| | 38 | 7~x | 1, 4, 5 | 2, 3, 6 |
| | 39 | 7~x | 4, 5 | 1, 2, 3, 6 |

TABLE 1-continued

AmkRINGS Algorithm
Step by Step Method of Moves

| NO. OF LAYER n | MOVE NO. m | ORIGINAL STATION | INTERIM STATION (EVEN NO. OF n) FINAL STATION (ODD NO. OF n) | FINAL STATION (EVEN NO. OF n) INTERIM STATION (ODD NO. OF n) |
|---|---|---|---|---|
| | 40 | 4, 7~x | 5 | 1, 2, 3, 6 |
| | 41 | 1, 4, 7 | 5 | 2, 3, 6 |
| | 42 | 1, 4, 7 | 2, 5 | 3, 6 |
| | 43 | 4, 7~x | 1, 2, 5 | 3, 6 |
| | 44 | 3, 4, 7~x | 1, 2, 5 | 6 |
| | 45 | 3, 4, 7~x | 2, 5 | 1, 6 |
| | 46 | 2, 3, 4, 7~x | 5 | 1, 6 |
| | 47 | 1, 2, 3, 4, 7~x | 5 | 6 |
| | 48 | 1, 2, 3, 4, 7~x | — | 5, 6 |
| | 49 | 2, 3, 4, 7~x | 1 | 5, 6 |
| | 50 | 3, 4, 7~x | 1 | 2, 5, 6 |
| | 51 | 3, 4, 7~x | — | 1, 2, 5, 6 |
| | 52 | 4, 7~x | 3 | 1, 2, 5, 6 |
| | 53 | 1, 4, 7~x | 3 | 2, 5, 6 |
| | 54 | 1, 4, 7~x | 2, 3 | 5, 6 |
| | 55 | 4, 7~x | 1, 2, 3 | 5, 6 |
| | 56 | 7~x | 1, 2, 3 | 4, 5, 6 |
| | 57 | 7~x | 2, 3 | 1, 4, 5, 6 |
| | 58 | 2, 7~x | 3 | 1, 4, 5, 6 |
| | 59 | 1, 2, 7~x | 3 | 4, 5, 6 |
| | 60 | 1, 2, 7~x | — | 3, 4, 5, 6 |
| | 61 | 2, 7~x | 1 | 3, 4, 5, 6 |
| | 62 | 7~x | 1 | 2, 3, 4, 5, 6 |
| | 63 | 7~x | — | 1, 2, 3, 4, 5, 6 |
| 7 | 127 | 8~x | 1, 2, 3, 4, 5, 6, 7 | — |
| 8 | 255 | 9~x | — | 1, 2, 3, 4, 5, 6, 7, 8 |
| 9 | 511 | 10~x | 1, 2, 3, 4, 5, 6, 7, 8, 9 | — |
| 10 | 1023 | 11~x | — | 1, 2, 3, 4, 5, 6, 7, 8, 9, 10 |
| 11 | 2047 | 12~x | 1, 2, 3, 4, 5, 6, 7, 8, 9, 10, 11 | — |
| 12 | 4095 | 13~x | — | 1, 2, 3, 4, 5, 6, 7, 8, 9, 10, 11, 12 |

If a correct move of the specifically designed ring/disk 11 has been made the said specifically designed central control unit device 20 will transmit instruction to the said Receiving specifically designed station 10 to light up the green lamp 12 for a short period and to the audio speaker 16 to make a short audio sound of correctness. The said specifically designed central control unit device 20 will count and add this move to the actual number of moves 'M' and instruct the display unit 30 to display this actual number of move at 'M' and 'P', 'Q', 'D', 'T', etc.

If the move of the specifically designed ring/disk 11 has not been made according to the step by step sequence of the AmkRINGS Algorithm per Table 1 and the mathematical formula [$m=2^n-1$], in the case said top specifically designed ring/disk 11 in the move is vacated from the incorrect specifically designed station 10, the said specifically designed central control unit device 20 will transmit instruction to the involved Vacating specifically designed station 10 to light up the red lamp 13 for a short period and the audio speaker 16 to make a short audio sound of error. The said specifically designed ring/disk 11 involved in the erroneous move will then be put back to involved specifically designed station 10 that it has last vacated; this information will be processed and count as one actual move and add on to the actual number of move 'M' and displayed: in the case said top specifically designed ring/disk 11 in the move is vacated from the correct Vacating Station of the specifically designed station 10 but moved to the incorrect Receiving Station of the specifically designed station 10, the said specifically designed central control unit device 20 will transmit instruction to the involved Receiving specifically designed station 10 to light up the red lamp 13 for a short period and to the audio speaker 16 to make a short audio sound of error. The said specifically designed ring/disk 11 involved in the erroneous move will then be taken out from the involved Receiving specifically designed station 10 and moved back to the involved Vacating specifically designed station 10 that it has last vacated before any new move can be made, both of the said specifically designed stations 10 will transmit this information to the said specifically designed central control unit device 20 to be processed. This information will be processed and counted as one actual move for the said incorrect move and add on to the actual number of move 'M' and displayed; for Player Mode 'S', the extra moves 'P' or 'Q' made, if any, to move back the said specifically designed ring/disk 11 involved in the erroneous move will also be counted, all data related to actual moves such as 'P', 'D', 'T', will correspond with the current updated 'M'; other than that the play status will be re-set as before said last move of the specifically designed ring or disk 11, $m^y$ and $n^y$, $p^y$, $d^y$ remain unchanged for this incorrect move, and the said specifically designed central control unit 20 will instruct the display unit 30 to display to resume the game. (Note: Play Mode 'A' is played according to the said two game rules only, where a player may take out any of the specifically designed ring/disk 11 from a specifically designed station 10 without error alarm even if the said the specifically designed ring/disk 11 is from the incorrect specifically designed station 10 as long as the said the specifically designed ring/disk 11 is the smallest (or at the top) in the said specifically designed station 10, or may put the moved specifically designed ring/disk 11 in the incorrect specifically designed station 10 without error alarm as long as the said the specifically designed ring/disk 11 is smaller than the specifically designed ring/disk 11 under it on the Receiving specifically designed stations 10, in both cases actual moves 'M' will increase, whereas Play Mode 'B' must be played according to the step by step sequence of the said 'AmkRINGS Algorithm' based on the said two game rules and the mathematical formula [$m=2^n-1$] for the minimum moves possible, that is the specifically designed rings or disks 11 for a move must be taken from the correct specifically designed station 10 (Vacating station) and stacked or placed at the correct specifically designed station 10 (Receiving station) and as such is at advance level and more difficult to play).

To play the Play Mode C, the player uses the menu functions browsing knob 23 and menu functions selector button 27 on the specifically designed central control unit device 20, selects the Play Mode C and the play mode indicator lamp 24C, will light up; the said specifically designed central control unit device 20 will process, as programmed, the AmkRINGS Algorithm of the step by step sequence of moves to achieve the minimum number of moves 'm' for any number 'n' of specifically designed rings/disks 11, according to the two game rules and according to the mathematical formula [$m=2^n-1$], and process a teaching mode for teaching or practicing the correct moves of the game. When this teaching mode is activated, the said specifically designed central control unit device 20 will transmit information so that starting from the beginning of the game and the very first move, the correct specifically designed station 10 (Vacating Station) from which the top specifically designed ring/disk 11 will be vacated will light up its blue lamp 14 until the said top specifically designed ring/disk 11 is vacated and the correct specifically designed station 10 (Receiving Station) to receive the said specifically designed ring/disk 11 will light up its blue lamp 14 intermittently until this said specifically designed ring/disk 11 is received and stacked. The said specifically designed central control unit device 20 will transmit this information to the display unit 30 to display the relevant numbers of moves 'm' being made. The teaching mode Play Mode C can be played by a solo player Player Mode 'S', by three players Player Mode 'T', 'TR', or by a group of players Player Modes 'GS', or 'GT', 'GTR'.

At any time of the game, the specifically designed central control unit device 20 is designed that, the solo player or players can pause the currently playing game temporarily without stopping the said game while keeping the game status at that point unchanged, and can resume the said game from the said paused status, when the said player applies the proper control functional buttons from the menu function browsing knob 23 and the menu function selection button 27 of the said specifically designed central control unit device 20. This allows the said player(s) to pause the game or the exercise for a short time when the need arises.

The specifically designed central control unit device 20 is designed that a solo player or players can stop the currently running game as an interval or as a session of an entire game at any stage or any time of the said game and to be restarted at a later chosen time, by applying the proper control functional buttons from the menu function browsing knob 23 and the menu function selection button 27; the said specifically designed central control unit 20 will save in its memory all the relevant data such as the game number, Play Mode, Player Mode and Game Mode, the player(s), date & time of the game, m, n, $M_i$, $m^y$, $n^y$, p, $p^y$, $P_i$, $Q_i$, L, d, $d^y$, $D_i$, $T_i$, but not limited to these, corresponding to the '$n^y$' numbers of the specifically designed rings or disks that have been moved out, for first time moves, from the Original specifically designed station 10 at this stage of interval or session; all said interval or session stopped game data for every interval or session will be saved in the said memory for future reference until the player deletes these; when a player or players restart an interval or a session stopped game, the specifically designed central control unit 20 will retrieve from the memory and input all the said relevant data as saved at the said last interval or session, display these at the Display unit 30 and check before the game restart that the items in play at the restart are set up by the player or players according to the data input of the said last interval or session, after receiving the transmitted information of the set up for the said restart from the three specifically designed stations 10, and then allow the game to re-start, and transmit to the Display unit 30 to display 'Start'. This interval or session stoppage feature of a game or exercise enables the solo player or players playing or exercising a long hours game, as example playing with a set of sixteen specifically designed rings or disks 11 ('n'), which will require 65,535 minimum moves ('m'), to break down the game and the exercise and schedule it to one or two hours per day game or exercise in sessions lasting for a week or a month, etc. as per choice until completion of the game. (During the session or interval stoppage, the player or players may or may not remove the play items such as the specifically designed rings or disks, from the set).

When the player(s) determined that a game has ended, the said player(s) enter 'End' on the specifically designed central control unit 20 menu function browser; then the said specifically designed central control unit device 20 processes, as programmed, and determines whether the set of specifically designed rings or disks 11 in play in said game is completely moved out from the specifically designed Original Station 10 and stacked finally, completely and correctly, that is in ascending order of size or shape or of serial number of the set from the top to the bottom or from the right to the left as the case may be, at the correct designated specifically designed Final Station 10, and if correct the said specifically designed central control unit device 20 will end the game and send signal to the Display Unit 30 to display the game end status, and if not correct, in case said set of the specifically designed rings or disks 11 are finally moved and stacked at the Interim Station or even came back and stacked at the Original Station of the specifically designed stations 10, or the said set of the specifically designed rings or disks 11 are not stacked in ascending order of size or shape or of serial number of the set from the top to the bottom or from the right to the left as the case may be, the said specifically designed central control unit device 20 will send signal to the Display Unit 30 to display the game fails.

The solo player or players may decide to continue the game from this game failed status and thus continue to add to actual moves to 'M', 'Q', 'Y', 'D' etc., or may decide to terminate the game without completing and without saving any status data and information of the game, in which case said specifically designed central control unit device 20 is so designed that the player(s) can apply the proper control functional buttons from the menu function browsing knob 23 and the menu function selection button 27 to terminate the game.

When the game ends for the present embodiment played with a set of six specifically designed rings or disks 11 ('n'), for a solo player playing with Player Mode 'S' and Game Mode 'PP', the specifically designed central control unit device 20 is designed to calculate that, if the said player has moved every step correctly according to the game rules, then he has made minimum 63 moves ('m') of the said specifically designed rings or disks 11, and has personally moved minimum 125 times ('p') between the said three specifically designed stations 10, and if the said three specifically designed stations 10 are places at a distance of 15 meters ('L') between one other as an example, the said player has moved a minimum distance of 1875 meters ('d'), by walking, jogging, skating, swimming in a pool, etc., depending on the sport or exercise type taken. If the said player has made errors in the moves adding additional moves during the play of the said game, the actual number of moves of the said specifically designed rings or disks 11 will be 'M', the actual distance moved by the said player ('D') will be actual personal moves ('P') times distance ('L'), which will all be calculated by the said specifically designed central control unit device 20 and will be displayed by the display unit device 30.

Detailed Description of the First Alternate and Second Alternate Embodiment

Figure 10:
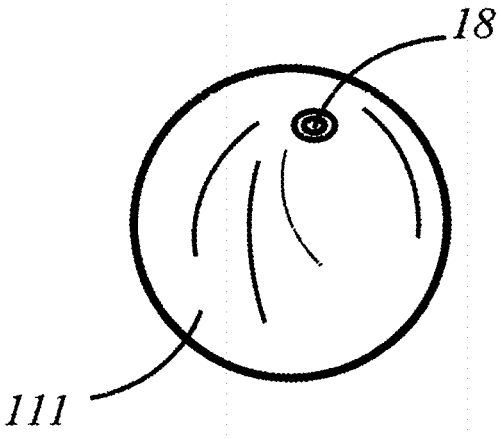
FIG. 10 is a diagrammatic perspective view of the first alternate embodiment of the present invention showing a specifically designed ball.

The first alternate embodiment of the present invention, in FIG. 10, is the specifically designed balls 111 of the same shape or feature and the same size and the same weight in a set in play and are of the type of articles of the existing established sports such as basketballs, water polo balls, netballs, handballs (Olympic handball, Team handball), footballs (soccer), hockey balls, golf balls, rugby balls, but not limited to these, and are specifically designed by incorporating with the identification tag (ID) 18 identifying the said specifically designed balls 111 in ascending order of the serial numbers in relation to its position within a set of said balls in play in said game, and the said specifically designed balls 111 are made visually identifiable by distinctly marked serial numbers and different colors or different tones of a color or colors related to their positions within a set of said balls in play in the said game.

Figure 11:
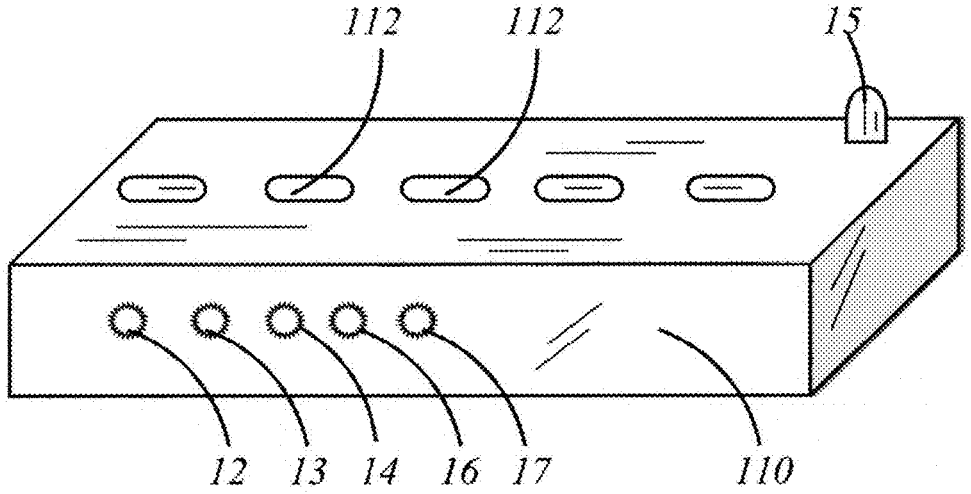
FIG. 11 is a diagrammatic perspective view of the second alternate embodiment of the present invention showing a specifically designed station of the horizontal stacking type.

The second alternate embodiment of the present invention, in FIG. 11, is one of three specifically designed stations 110, here shown with five slots or spaces 112, but not limited to this, of the same shape or feature and the same size and able to receive and stack or place a set of the said specifically designed balls 111 in horizontal position in the ascending order, from the right to the left, of the serial numbers of the said specifically designed balls 111, in relation to its position within a set of said balls in play in said game; the first one of the said three specifically designed stations 110 is designated the Original Station with basic blue color, the second one is designated the Interim Station with basic yellow color, and the third one is designated the Final Station with basic green color; each of the said three specifically designed stations 110 is equipped with devices that are the green lamp 12, red lamp 13, blue lamp 14, transmitter/receiver-cum-ID tracking device 15, audio speaker 16, power on/off switch 17, all of which function in the same way as the respective devices equipped at the specifically designed stations 10 of the preferred embodiment of the present invention. The slot or space 112 may be made visually identifiable by distinctly marked serial numbers in ascending order from the right to the left in relation to its position within a set of said balls 111 in play in said game, and by different color or different tones of a color or colors related to its position of the serial number without interfering the three basic colors of green, yellow and blue designated to each of the said three specifically designed stations 110.

Figure 12:
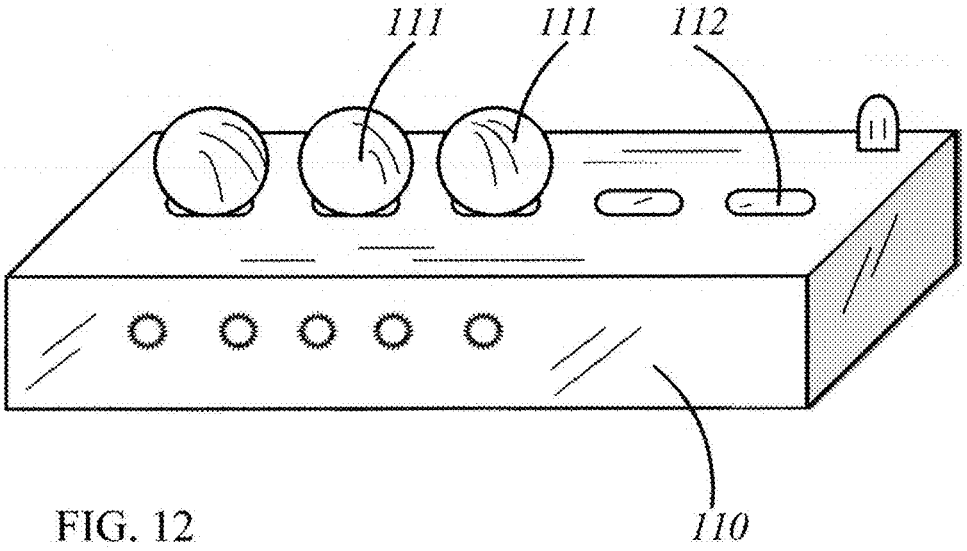
FIG. 12 is a diagrammatic perspective view showing a set of the specifically designed balls of the first alternate embodiment of the present invention as stacked or placed on a specifically designed station of the horizontal stacking type of the second alternate embodiment of the present invention.

FIG. 12 shows a set of three units of the said specifically designed balls 111 of the first alternate embodiment of the present invention as stacked or placed in slots or spaces 112 of one of the said specifically designed stations 110 of the second alternate embodiment of the present invention with two slots or spaces free. The said specifically designed balls 111 can be stacked from the right to the left in ascending order of the serial numbers in full set or any partial number of a set. The said specifically designed station 110 are designed so that any partial number of the set can also be stacked in ascending order of serial number but not necessarily in consecutive serial number order, from the right to the left; this is Type One of the said specifically designed station 110 of the second alternate embodiment of the present invention. Alternately the said specifically designed station 110 may also be designed so that the partial set of the said specifically designed balls 111 can be stacked in the assigned slots 112 with serial numbers corresponding to the serial numbers of the said specifically designed balls 111; this is Type Two of the said specifically designed stations 110 of the second alternate embodiment of the present invention. Both said types of the specifically designed stations 110 of the second alternate embodiment of the present invention are designed to be able to identify the said specially designed balls 111 moving in or out of the said specifically designed station 110, by the transmitter/receiver-cum-ID tracking device 15.

When the game is played, the moves follow the first game rule of moving the specifically designed ball 111 of the first alternate embodiment of the present invention, one at a time, from one specifically designed station 110 to another specifically designed station 110 of the second embodiment of the present invention at a time; the game can be played in Player Mode 'T' by three players each manning at one of the said three specifically designed stations 110 of the second alternate embodiment of the present invention placed at distances 'L' from one another, by taking out, throwing or passing, catching and stacking or placing the set of said specifically designed balls 111 in play, and can be played in Player Mode 'TR' with anyone of the three players moving, one player at a time manually taking out and carrying the specifically designed rings/disks 11 in play, one specifically designed ring/disk 11 at a time, moving by walking, jogging, swimming, skating etc., from one to any other one of the three specifically designed stations 10 placed at distances 'L' from one another, and stacking or placing, for relay game type Game Mode 'RR', such as for a baton relay game with a team of three players, with 'L' distance increased to 25 meters, 50 meters, etc. for examples; the game can be played in Player Mode 'S' by a solo player, manually taking out and carrying the said specifically designed balls 111 in play, one specifically designed ball 111 at a time, moving by walking, jogging, swimming, skating etc., from one to any other one of the said three specifically designed stations 110 placed at distances 'L' from one another, and stacking. Additionally, the game can be played in Player Modes 'GT' and 'GTR' by a group of players in three player teams, or Player Mode 'GS' by a group of players who play solo, playing alternately in turns or by sessions for long games. All the Player Modes can be chosen by applying the proper control functional buttons from the menu function browsing knob 23 and the menu function selection button 27 at the specifically designed central control unit device 10.

The move of the said specifically designed balls 111 of the first alternate embodiment of the present invention being vacated from one said specifically designed station 110 of the second alternate embodiment of the present invention which is designated the Vacating Station for this move, and each being the right-most specifically designed ball 111 which is of the lowest serial number if there are more than one said specifically designed ball 111 at the said Vacating Station of the specifically designed station 110, to another of said specifically designed station 110, designated the Receiving Station for the said move, follows the second game rule that the said specifically designed ball 111 being moved must be lower in serial number than the serial number of the right-most specifically designed ball 111 already at the said Receiving Station of the specifically designed station 110, if the said Receiving Station of the specifically designed station 110 already has one or more of the said specifically designed ball 111 stacked on it. For Type One of the said specifically designed Receiving station 110, the said specifically designed ball 111 being moved will be placed on the first vacant slot or space 112 from the left at the said Receiving Station 110. For Type Two of the said specifically designed Receiving station 110, the said specifically designed ball 111 being moved will be placed at the relevant slot or space 112 with corresponding serial number at the said Receiving specifically designed station 110 of the second alternate embodiment of the present invention.

For Game Mode 'RR', where a relay game is played, only the moves of the specifically designed balls 111 of the first alternated embodiment of the present invention is required to follow the two game rules, whereas the players in the team of three may not be fixed with any specifically designed ball 111 for carrying and may not move with any fixed specifically designed ball 111 as long as only one player is moving while carrying a specifically designed balls 111 being moved in play at a time; this is to even out the distances each player has to cover. A player may move freely anytime without carrying any specifically designed balls 111 to position himself or herself at any one specifically designed station 110, for the next move with the specifically designed balls 111 in play. Game Mode 'RR' may also be played with players moving in one direction only (clockwise or anti-clockwise) instead of to and fro between two stations, when moving a specifically designed ball 111.

The game and functions of the equipments played with the said specifically designed balls 111 of the first alternated embodiment of the present invention and the said specifically designed station 110 of the second alternate embodiment of the present invention, in conjunction with and concurrently with the specifically designed central control unit device 20 and the display unit device 30, will continue to follow other aspects of the game and functions of the equipments as for the specifically designed rings or disks 11 and the specifically designed station 10 of the preferred embodiment of the present invention in conjunction with and concurrently with the specifically designed central control unit device 20 and the display unit device 30, such as selecting the Play Mode A, B, C, Player Mode 'S', Competition Modes 'UA' or 'BA', 'T', 'TR', 'GS', 'GT', 'GTR', 'CS', 'CT', Game Mode 'PP', 'QQ', 'RR', identifying, transmitting, calculating, counting, processing and displaying m, n, M, $M_i$, $m^y$, $n^y$, p, $p^y$, P, $P_i$, Q, $Q_i$, L, d, $d^y$, D, $D_i$, T, $T_i$, selecting game pause, game interval stop, game end, but not limited to these.

For those specific games using the said specifically designed balls 111 of the first alternate embodiment of the present invention related to any of the current established sports such as water polo, basket ball, football (soccer), handball (Olympic handball, Team handball), netball, rugby, hockey, polo, golf, etc., but not limited to these, specifically designed equipment and facilities which are related to the said current established sports and which are incorporated with the said devices of the present invention, are provided for the game.

Figure 13:
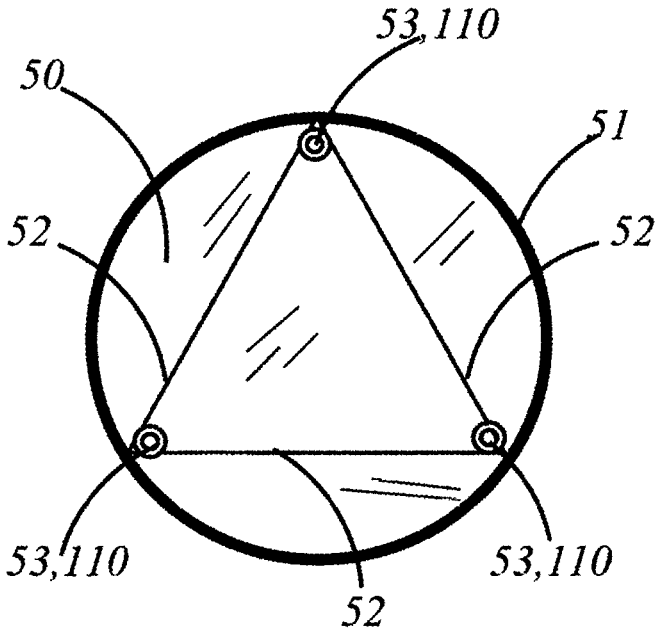
FIG. 13 is the plan view of the specifically designed playground with circular boundary circumscribed by an imaginary equilateral triangle at the three vertices of which are the goal posts.

FIG. 13 shows the specifically designed playing ground (field, pitch) 50 of circular shape, the circular boundary 51 of which is circumscribed by an imaginary equilateral triangle with sides 52, for playing the established sport game types of basket ball, net ball, football (soccer), hand ball (Olympic handball, Team handball), hockey, water polo, polo, golf, but not limited to these; the three goal posts or point scoring posts 53 or 54 or 55 each incorporated with one of the three specifically designed stations 110 are at the three vertices of the imaginary equilateral triangle with sides 52, and the said posts are placed at vertical heights from the ground relevant to the existing established sport games; the length of each of the three sides 52 of the imaginary equilateral triangle, which is distance 'L' between any two of the specifically designed goal posts 53 or 54 or 55, is set within a range of fixed lengths, including 1 times and 1.15 times the width of the current playground of the respective sport game type, but not limited to this; thus applying any one of the said two fixed lengths, the current standard playgrounds (fields, pitches) can be adapted for use with minor modification for this game of the invention. Longer lengths 52 requiring bigger playgrounds (fields, pitches) 50 can be applied by construction of new playgrounds (fields, pitches). The floor of the specifically designed playground (field, pitch) 50 is constructed with standard materials as for standard playgrounds (fields, pitches) of the relevant established sport.

Another variation in shape of the specifically designed playground (field, pitch) 50 has regular hexagonal shape circumscribed by an imaginary equilateral triangle, for playing the sport game types of basket ball, net ball, football (soccer), hand ball, rugby, hockey, water polo, but not limited to these, with the three vertices of the said imaginary equilateral triangle of sides 52 touching at the midpoint of the three alternate sides of the regular hexagon (Figure not shown); the length of each of the three sides 52 of the imaginary equilateral triangle is set within a range of fixed lengths, including 1 time and 1.15 times the width of the current playground of the respective sport game type, but not limited to this, and at each of the three vertices of the imaginary equilateral triangle, a specifically designed goal post 53 or 54 or 55 each incorporated with one of the three specifically designed stations 110 is positioned, in the specifically designed playground (field, pitch), and the said posts are placed at vertical heights from the ground relevant to the existing established sport games.

Still another variation in shape of the specifically designed playground 50 is in the hexagonal shape (not regular hexagon), the lengths of the three alternates sides of the hexagon shape playground (field, pitch) 50 that do not have the goals or goal posts can be equally longer that the lengths of the three alternate sides of the hexagonal shape playground 50 that have the goals or goal posts at the midpoints; this is to provide a specifically designed playground (field, pitch) 50 with a variation of the floor space, the floor of which is constructed per the standard materials used for the established current relevant established sport.

For sport game type of basket ball, net ball, rugby, etc., that normally do not have particular goal defenders or goal keepers positioned at the goalposts, the specifically designed goal posts 53 have the same feature and dimensions as the relevant current established sports and further incorporated with sensors 56, as programmed, electronic or otherwise, capable to detect and determine that a goal has been scored, and capable to determine the ID of the specifically designed ball 111 that scored the goal and capable to transmit this information to the relevant specifically designed station 110 incorporated with the said goal post 53.

Figure 14:
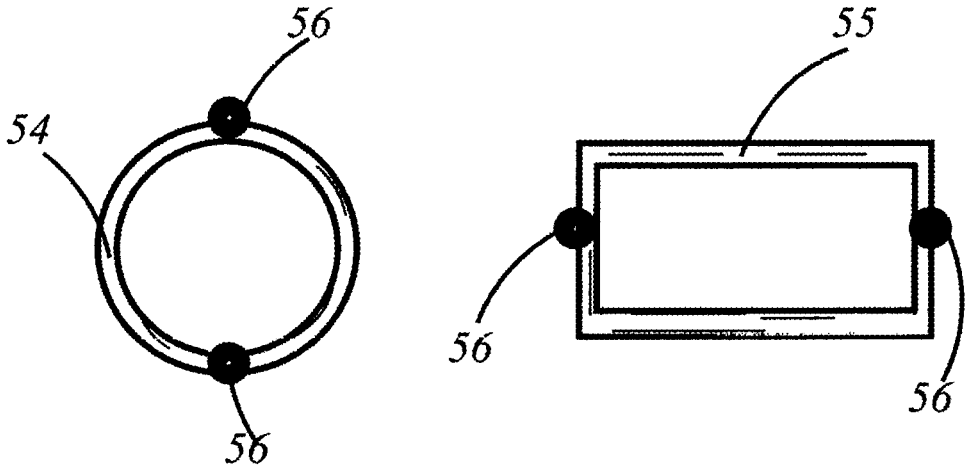
FIG. 14 is the plan view of the specifically designed goal posts of circular type and rectangular type with sensors.

FIG. 14 shows the specifically designed goal posts in round shape 54 or in rectangular shape 55 as relevant for playing the sport game types of football (soccer), hand ball (Olympic handball, Team handball), hockey, water polo, but not limited to these, for the type of games that normally have particular goal defenders or goal keepers positioned at the goalposts or goals, that the internal diameter or the inside sides of each of the three specifically designed goal posts 54 or 55 respectively is between two to four times the diameter of the current ball of the respective sport game type but not limited to this, and have sensors 56, as programmed, electronic or otherwise, capable to detect and determine that a goal has been scored, and capable to determine the ID of the specifically designed ball 111 that scored the goal, and capable to transmit this information to the relevant specifically designed station 110 incorporated with the said goal post 54 or 55. There are no particular goal defenders or goalkeepers positioned at the goal posts 54 or 55 for this embodiment of the game of invention; there is only one of this specifically designed goal post 54 or 55 at each vertex of the imaginary triangle and coupled to a specifically designed station positioned at the vertex.

A variation of the preferred embodiment is, for playing the sport game types of football, hand ball, hockey, water polo, but not limited to these, which are the type of established games that normally have particular goal defenders or goalkeepers positioned at the goalposts, to provide two standard goalposts 53 relevant to the sport in play at each of the three vertexes of the imaginary triangle, side by side and one meter apart, both coupled to the one specifically designed station 110 of that vertex, one goalpost 53 guarded by a goalkeeper from one side of the two competing teams, the other goalpost 53 guarded by a goalkeeper from the other side of the two competing teams, each goal keeper fending off any goal going into his/her post he/she is defending. There will be six standard goalposts 53 and six goalkeepers, three from each competing team, on the playground during play. Note there are only three specifically designed stations 110 involved, each one coupled to the two goalposts 53 at each vertex of the imaginary triangle.

For the specifically designed balls 111 of the first alternate embodiment of the present invention of the basketball type, a specifically designed basketball ground 50 with three standard back boards and each with specifically designed goal post 53 incorporated with the said sensor 56 for determination of goal scoring, tracking, identification, transmission, are provided; the three boards and goal posts 53 are incorporated with the three specifically designed stations 110 of the second alternate embodiment of the present invention at pre-determined distance 'L' from one another, which normally will be the length of the side 52 of the imaginary equilateral triangle, and are utilized in conjunction with the specifically designed central control unit device 20 and display unit device 30. With the Player Mode 'S' or 'GS' the solo player(s) can play Game Mode 'PP' bringing and shooting the balls alone or for Player Mode 'CS' the game may include a defender(s) to play against the solo player(s), and utilizing the normal functions of the specifically designed central control unit device 20 and the display unit device 30.

Specifically designed playground 50, three specifically design goal posts 53 which are incorporated with the said sensor 56 for determination of goal scoring, tracking, identification, transmission, and are incorporated with the three specifically designed stations 110 placed at pre-determined distance 'L' from one another, which normally will be the length of the side 52 of the imaginary equilateral triangle, and used in conjunction with the specifically designed central control unit 20 and display unit 30, are provided for the specifically designed balls 111 of the first alternate embodiment of the present invention of the type of net ball, as the case for the basket ball type of game.

Specifically designed playground 50 (field, pitch), three specifically designed goalposts 54 of sizes two to four times the diameters of the standard ball and which are incorporated with the said sensor 56 for determination of goal scoring, tracking, identification, transmission, and are incorporated with the three specifically designed stations 110 placed at pre-determined distance 'L' from one another, which normally will be the length of the side 52 of the imaginary equilateral triangle, are provided for the specifically designed balls 111 of the first alternate embodiment of the present invention of the types of foot ball (soccer), hand ball (Olympic handball, Team handball), hockey ball, but not limited to these types, which for normal games will have particular goal defenders or goalkeepers positioned at the goals or goalposts, and the games are played utilizing the functions of specifically designed control unit 20 and display unit 30. For the unique game in play of the present invention, there are no goal keepers positioned at the goals or goalposts.

For the specifically designed balls 111 of the first alternate embodiment of the present invention of the water polo ball type, a specifically designed swimming pool in the shape of playground 50, three specifically designed goal posts 54 of diameters two to four times that of the standard ball and which are incorporated with the said sensor 56 for determination of goal scoring, tracking, identification, transmission, will be provided; the three goal posts 54 are incorporated with the three specifically designed stations 110 at pre-determined distance 'L' from one another, which normally will be the length of the side 52 of the imaginary equilateral triangle. With the Player Mode 'S' or 'GS' the solo player(s) can play Game Mode 'PP' bringing and shooting the balls alone or the game may include a defender(s) to play against the solo player(s) for the Player Mode 'CS', and the games are played utilizing the functions of the specifically designed central control unit device 20 and the display unit device 30. For the unique game in play of the present invention, there are no goal keepers.

Figure 15:
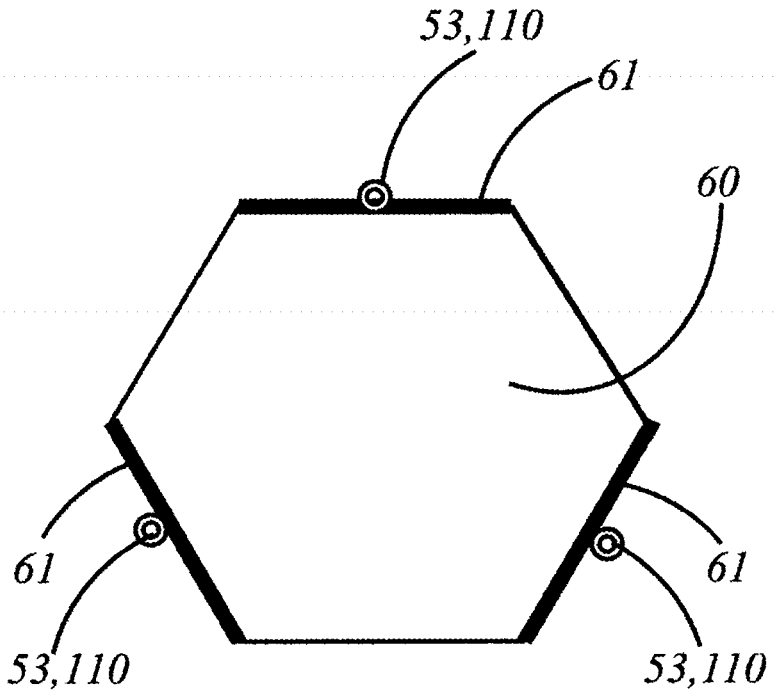
FIG. 15 is the plan view of the specifically designed playground with regular hexagonal shape boundary with specifically designed goal posts and goal lines

FIG. 15 shows the specifically designed playing ground 60 of regular hexagon shape, with the three goal lines 61 at three alternate sides of the six sides of the regular hexagon 60, the other three alternate sides being touchlines, for playing the sport game types such as rugby, but not limited to this, the length of each of the six sides including goal lines 61 of the regular hexagon, is set within a range of fixed lengths, including 0.57 times and 1.0 times the width of the current standard playground of the respective sport game type, but not limited to this; thus by applying 0.57 times the standard width to the length of the six sides, the current standard playgrounds can be adapted for use with minor modification for this game. Longer lengths for bigger playgrounds 60 can be applied by construction of new playgrounds. The three goal posts 53 each incorporated with one of the three specifically designed stations 110 are at the midpoint of each of the three goal lines 61, and the said posts are of standard dimensions and design and placed to standard vertical heights from the ground relevant to the established sports games. Three in-goal areas of appropriate size are added from the goal lines 61 (include goal lines) to the outside space of the goal lines 61. The floor of the specifically designed playground (field, pitch) 60 is constructed with standard materials as for standard playgrounds (field, pitch) of the relevant sport.

For the specifically designed balls 111 of the first alternate embodiment of the present invention of the rugby ball type, a specifically designed rugby playground (field, pitch) 60 with regular hexagon shape, with three goal lines 61 at alternate sides of the regular hexagonal playground (field, pitch) 60 and each goal lines with specifically designed goal post 53 at its midpoint and incorporated with the said sensor 56 for determination of goal scoring, tracking, identification, transmission, are provided; the goal posts 53 are incorporated with the three specifically designed stations 110 of the second alternate embodiment of the present invention, and the game utilizes the normal functions of the specifically designed central control unit device 20 and the display unit device 30.

For the specifically designed balls 111 of the first alternate embodiment of the present invention of the golf ball type, a specifically designed putting green ground 50 and three specifically designed putting holes 53, natural or artificial, and incorporated with the said sensor devices 56 for determination of putting stroke scoring, tracking, identification, transmission, will be provided; the said putting green ground and the said putting holes are incorporated with the three specifically designed stations 110 which are positioned at pre-determined distance 'L' suitable for the putting game and the player or players will use a normal golf putter. For a chipping or pitching type of game, a specifically designed pitching ground 50 with three putting greens included, natural or artificial, incorporated with the three specifically designed stations 110, with distances 'L' suitable for chipping or pitching, will be provided and the player or players will use an appropriate normal golf clubs such as sand wedges, putters. Player mode 'S' 'GS', is applicable for both games of putting and pitching. For the Player Mode 'S' type, the distance 'D' covered by the solo player can be calculated using Game Mode 'QQ', and utilizing the functions of the central control unit device 20 and the display unit device 30.

For the said specifically designed balls 111 of the first alternate embodiment of the present invention of the types basketball, net ball, hand ball (Olympic handball or Team handball), football (soccer), hockey ball (puck), rugby ball, water polo ball, polo ball, but not limited to these, utilizing the respective equipments and devices of the invention which are the said specifically designed playgrounds (fields, pitches) 50 or 60, said specifically designed goal posts 53 or 54 or 55, said three specifically designed stations 110 of the second alternate embodiment of the invention, the specifically designed central control unit device 20 and display unit device 30, players in teams of two players or more than two players in Player Mode 'CT' can play in team competition, one team against another, following the said basic two game rules in Play Mode A or following the AmkRINGS Algorithm in Play Mode B, and following the standard rules and regulation of each established sport, with some added or altered rules to the established as relevant for this specific game of utilizing said articles of the present invention, and such added or altered rules may be set by a relevant sport governing body for the specific sport.

For the said competition by teams in Player Mode 'CT', a team will comprise of two and above players and two team will compete against one other in a game utilizing said articles of the invention. There are two types of Competition Modes that can be played by utilizing said articles of the invention: Competition Mode 'UA' & Competition Mode 'BA'.

Competition Mode 'UA' (Unilateral Attempt) competition is when one team in possession of the set of the specifically designed balls 111 in play will attempt at goals or at scoring points at goalposts 53 or 54 or 55 using a determined set of the specifically designed balls 111 while the other team will prevent or hinder the first team from scoring the goals or points, and after one side has completed the move of the whole set of the specifically designed balls 111 in play from the Original to Final specifically designed station 110, the other side takes alternate possession of the set of the specifically designed balls 111 and continues the game. The competition can be score and/or time based. In general the team that completed the move of the whole set of specifically designed balls 111 in play from the Original to Final specifically designed station 110 in the shorter time will be the winner. For a fixed time period type of game, the team that completed the higher 'n'' at the end of a fixed time will be the winner. The number 'n' of the specifically designed balls 111 in a set will determined the level of the game, the higher the number of said balls 111 in a set, the more advance the game. For 'UA' type of competition, Play Mode 'A' and Play Mode 'B' can be played.

Competition Mode 'BA' (Bilateral Attempt) competition is when both teams will try to possess the specifically designed ball 111 in play and simultaneously attempt at goals as in a normal mentioned sport game type, using a determined set of the specifically designed balls 111. For this type of 'BA' competition, only Play Mode 'B' can be played and is more complicated to play; a player or the side which gets possession of a specifically designed ball 111 in play must know correctly at which of the specifically designed three goal posts 53 or 54 or 55, incorporated with the specifically designed station 110, to score, and the team that will get possession of the specifically designed ball 111 at restart after a goal or point score, depending on the type of sport played, must then pick up the next specifically designed ball 111 correctly from one of the three specifically designed station 110, to continue the game. For this 'BA' game, which team scores or be penalized for each correct move or incorrect move respectively of the specifically designed ball 111 will be decided by the human umpire or umpires, in addition to the functions of the specifically designed central control unit device 20. The competition can be score and/or time based. On scores penalty points for incorrect moves may be incurred. Generally the team with the higher score—after minus the penalty points—is the winner, after the whole set of the specifically designed balls 111 in play have been moved from the Original to Final specifically designed station 110. The game may be a draw also, for the same score results. For 'BA' type of competition, there is no necessity for alternate possession of the set of the specifically designed balls 111 in play after completion of the move of the whole set from the Original Station to the Final Station 110. The number of the specifically designed balls 111 in a set will determined the level of the game, the higher the number 'n' of specifically designed balls 111 in a set, the longer and more advance the game. Since both teams are attempting for goals or points at the same goal post 53 or 54 or 55 at any time of the game, a player is required to have total skill, being a striker, a defender, a winger, etc., at the same time for certain established sports.

Player Mode 'CS' can also play the 'UA' and 'BA' competitions with one player playing against another one.

The third alternate embodiment of the present invention is the specifically designed rings/disks 91 (Figure not shown) which are articles of 11 or 111 and which have visual identification means to identify the specifically designed rings/disks 91 of the position within a set in play by serial numbers, different colors or different tones of a color or colors but are not equipped with the identification tag 18, and the specifically designed stations 90 (Figure not shown) which are articles of 10 or 110 but are not equipped with any electrical, electronic transmitter, receiver, ID tracking device 15, and goal posts or goals 53, 54, 55, which are not equipped with electronic devices; the specifically designed central control unit 20 and the electronic display unit 30, are not included in or incorporated with the game equipments utilizing the third alternate embodiment.

The moves of the game using the said third alternate embodiment of the present inventions of the said specifically designed rings/disks 91 and the said specifically designed stations 90 will be monitored by a human empire or referee to follow the said two game rules and the 'AmkRINGS Algorithm' and can play Play Mode 'A' and Play Mode 'B' and the players may play on the specific playgrounds (fields, pitches) 50, 60; the minimum possible number of moves 'm' for any 'n' can be calculated using an electronic calculator or referring to a provided table of versus 'n', and the actual number of moves 'M' made will be counted manually using the ordinary hand held press-button counter device or any type of manual counter or display. The step by step moves for Play Mode 'B' can be monitored utilizing 'AmkRINGS Algorithm' tables with charts or aids by assistant umpires or game assistant officials. The third alternate embodiment of the present inventions of the said specifically designed rings/disks 91 and the said specifically designed stations 90 are intended for a simpler and more economically viable form of playing the said game.

It will be understood that each of the elements described above, or two or more together, may also find a useful application in other types of constructions differing from the types described above.

While the invention has been illustrated and described as embodied in the rings or disks or balls or rods and the three stations, the central control unit device, the display unit device, the playgrounds and the goal posts of specific design with or without electronic identification, tracking, data transmission, processing and display functions for the physical indoor or outdoor game, it is not limited to the details shown, since it will be understood that various omissions, modifications, substitutions and changes in the forms and details of the devices illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the stand point of prior art, fairly constitute characteristics of the generic or specific aspects of this invention.

The claims defining the invention are as follows:

1. A physical game comprising:

at least three stations, each station being physically located apart from one another, wherein one of said stations is designated an original station and another the final station;

a plurality of movable articles being at least of different sizes, wherein each article is equipped with at least one identification device providing each movable article with a detectable identity in relation to its unique position of the said plurality of movable articles, wherein at commencement of the game, all of the movable articles are located at the designated original station in a predetermined sequence of size, and a controller for receiving data from the identification device;

wherein each station includes at least one detector for: detecting the position of the relative to the station; identification of said article; and transmitting at least one signal to the controller, wherein said at least one signal includes information relating to the detection and identification of said moveable article and identification of the station; and wherein at the completion of the game all of the movable articles are located at the designated final station in a same sequence as found at the first station at commencement of the game;

the controller receiving the at least one signal from each station, the at least one signal having data identifying the station, the detection and identification of said moveable article once it has been moved relative to the station, and whereby said controller processes the at least one received signal to determine whether the article has been moved to or from a specific location in accordance with rules of the game;

a visual display unit equipped to display information to at least one game participant; and providing a playground on which to stage the game;

wherein the physical game is played by at least one participant moving one moveable article between the at least three stations in a particular sequence, the sequence requiring that the station receiving the moveable article already contains articles which are greater in size than the article being moved by the at least one game participant to the station.

2. The physical game of claim 1, wherein the movements of the articles in the particular sequence are aiming for a minimum number of moves possible m, for a defined number of articles, n, wherein $m=2^n-1$.

3. The physical game of claim 1, wherein the controller determines whether the movable article is moved to a station based on the particular sequence based on the signal from each station and if the controller determines that the moveable article is moved to the station based on the particular sequence, the controller sending an indication to the station.

4. The physical game of claim 3, wherein the indication at the station is selected from the group consisting of a visual indication and an audio indication.

5. The physical game of claim 1, wherein the moveable articles moved between the stations are selected from the group consisting of: rings, discs, balls, rods of regular or irregular shape, pucks, darts and arrows each with at least one said identification device.

6. The physical game of claim 5, wherein the moveable articles moved between the stations comprises a plurality of articles in a plurality of sizes which can be arranged in an ascending order of size and further defined by another characteristic of the moveable article.

7. The physical game of claim 5, wherein the at least one identification device of the moveable article is selected from the group consisting of electronic chips, radio frequency tags, magnetic strips, bar codes, color codes and audio tonal devices.

8. The physical game of claim 1, wherein the stations receive and accommodate the moveable articles in a particular arrangement once moved to the station.

9. The physical game of claim 8, wherein each of the stations further comprises receptacles for receiving at least a portion of the moveable articles, the receptacles being selected from a group consisting of: rods, slots, holes, slits and depressions.

10. The physical game of claim 8, wherein the stations are selected from the group consisting of: goal posts, goal lines, archery targets, darts targets, basketball hoops, netball hoops and golf cups.

11. The physical game of claim 1, wherein the detector of each station is selected from the group consisting of electronic sensors and readers, proximity sensors, and code readers, wherein the code readers detect, read and identify electronic chips, radio frequency tags, magnetic strips, bar codes, color codes and audio tonal signals from the moveable articles.

12. The physical game claim 1, wherein the visual display unit receives data from said controller to display information regarding game set up and live progress.

13. The physical game of claim 1, wherein the stations are located on a field associated with moveable article.

14. The physical game of claim 1, wherein the at least one participant comprises at least two teams, each team comprising at least two players wherein at least one player of each team is selected to be:

(i) located at a station and does not move to other stations during the game;

(ii) moving between stations with or without the moveable articles during the game; or (iii) moving between stations during the game, only after the moveable particle has been moved.

15. The physical game of claim 5, wherein the moveable articles moved between the stations comprises a plurality of articles in a plurality of sizes which can be arranged in ascending order of size.

16. A method of playing a game comprising the steps of:

providing at least three stations, each station being physically located apart from one another, wherein one of said stations is designated an original station and another the final station;

providing a plurality of movable articles being at least of different sizes, wherein each article is equipped with at least one identification device providing each movable article with a detectable identity in relation to its unique wherein at commencement of the game, all of the movable articles are located at the designated original station in a predetermined sequence of size, and providing a controller for receiving data from the identification device;

wherein each station includes at least one detector for: detecting the position of the relative to the station; identification of said article; and transmitting at least one signal to the controller, wherein said at least one signal includes information relating to the detection and identification of said moveable article and identification of the station; and wherein at the completion of the game all of the movable articles are located at the designated final station in a same sequence as found at the first station at commencement of the game;

providing the controller receiving the at least one signal from each station, the at least one signal having data identifying the station, the detection and identification of said moveable article once it has been moved relative to the station, and whereby said controller processes the at least one received signal to determine whether the article has been moved to or from a specific location in accordance with rules of the game;

providing a visual display unit equipped to display information to at least one game participant and providing a playground on which to stage the game;

wherein the physical game is played by the steps of: at least one participant moving one moveable article between the at least three stations in a particular sequence, the sequence requiring that the station receiving the moveable article already contains articles which are greater in size than the article being moved by the at least one game participant to the station; the at least one participant repeating the step of moving the one moveable article between the at least three stations in the particular sequence until no moveable articles remain.

* * * * *